US011644773B2

(12) United States Patent
Saitoh

(10) Patent No.: US 11,644,773 B2
(45) Date of Patent: May 9, 2023

(54) HEATING DEVICE, FIXING DEVICE AND IMAGE FORMING APPARATUS

(71) Applicant: Seiji Saitoh, Kanagawa (JP)

(72) Inventor: Seiji Saitoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/462,376

(22) Filed: Aug. 31, 2021

(65) Prior Publication Data

US 2022/0091546 A1 Mar. 24, 2022

(30) Foreign Application Priority Data

Sep. 23, 2020 (JP) ..... JP2020-158612

(51) Int. Cl.
*G03G 15/20* (2006.01)
*G03G 21/20* (2006.01)

(52) U.S. Cl.
CPC ..... *G03G 15/2053* (2013.01); *G03G 15/2039* (2013.01); *G03G 15/2064* (2013.01); *G03G 21/206* (2013.01)

(58) Field of Classification Search
CPC ..... G03G 15/2064; G03G 15/2042; G03G 15/2039; G03G 21/1633; G03G 2221/1639
See application file for complete search history.

(56) References Cited

U.S. PATENT DOCUMENTS 5,208,612 A * 5/1993 Obu ..... G03G 21/1604 399/361
2007/0196152 A1* 8/2007 Shimizu ..... G03G 15/6573 399/405
2014/0112680 A1 4/2014 Ueno et al.
2014/0219674 A1* 8/2014 Asami ..... G03G 15/2017 399/69
2018/0157003 A1* 6/2018 Tsuchihashi ..... G03G 15/2042
2020/0387102 A1* 12/2020 Midorikawa ..... G03G 15/6552
(Continued)

FOREIGN PATENT DOCUMENTS

CN 103376722 A * 10/2013 ..... G03G 15/2017
JP 2007079042 A * 3/2007 ..... G03G 15/2017
JP 2009-300856 12/2009
(Continued)

*Primary Examiner* — Sevan A Aydin
(74) *Attorney, Agent, or Firm* — Harness, Dickey & Pierce, P.L.C.

(57) ABSTRACT

A heating device includes a heating rotator, a pressing rotator, a heater inside the heating rotator, a fan, a housing, and a pair of shutters. The pressing rotator presses against the heating rotator to form a nip passing through a recording medium. The housing houses the heating rotator and the pressing rotator. The housing has a pair of openings each configured to allow airflow generated by the fan to pass through each of the pair of openings. The pair of shutters each slide in corresponding one of the pair of openings in a longitudinal direction of the corresponding opening. Each shutter slides between a position at which an outer end portion of the corresponding opening is opened in the longitudinal direction of the corresponding opening and a position at which an inner end portion of the corresponding opening is opened in the longitudinal directions of the corresponding opening.

14 Claims, 12 Drawing Sheets

(56) References Cited

U.S. PATENT DOCUMENTS

| | | | |
|---|---|---|---|
| 2021/0041810 | A1 | 2/2021 | Furuichi |
| 2021/0041832 | A1 | 2/2021 | Furuichi |

FOREIGN PATENT DOCUMENTS

| | | | | |
|---|---|---|---|---|
| JP | 2013109014 | A | * | 6/2013 |
| JP | 2014-071234 | | | 4/2014 |
| JP | 2014-102486 | | | 6/2014 |
| JP | 2016-114655 | | | 6/2016 |
| JP | 2019-056812 | | | 4/2019 |
| JP | 2019-095533 | | | 6/2019 |

* cited by examiner

FIG. 9

| SHEET SIZE | A3 | B4 | A4 | B5 | A5 | B6 | A6 |
|---|---|---|---|---|---|---|---|
| POSITION OF SHUTTER | ARBITRARY POSITION | POSITION TOWARD CENTER | ARBITRARY POSITION | POSITION TOWARD CENTER | POSITION TOWARD CENTER | POSITION TOWARD END | POSITION TOWARD END |
| EFFECTIVE SHIELDING WIDTH | — | SHUTTER WIDTH | — | B5 SHEET WIDTH | A5 SHEET WIDTH | SHUTTER WIDTH | SHUTTER WIDTH |
| BLOWER FAN CONTROL | STOPPED | STOPPED OR LOW TO HIGH | STOPPED | HIGH | HIGH | STOPPED OR LOW TO HIGH | HIGH |
| ILLUSTRATED FIG NUMBER | FIG.7A | FIG.7B | FIG.7C | FIG.7D | FIG.7E | FIG.7F | FIG.7G |

HEATING DEVICE, FIXING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-158612, filed on Sep. 23, 2020 in the Japan Patent Office, the entire disclosure of each of which is hereby incorporated by reference herein.

BACKGROUND

Technical Field

Embodiments of the present disclosure relate to a heating device, a fixing device, and an image forming apparatus, and more particularly to a heating device including a cooling device to cool a part of the heating device, and a fixing device and an image forming apparatus including the heating device.

Related Art

Various types of fixing devices used in an electrophotographic image forming apparatus are known, and one of the types is a surf fixing system that is excellent in energy saving performance and short in warm-up time. In the surf fixing method, a thin fixing belt having a low thermal capacity is contact-heated from the inside by a planar heater, a sheet passing through a fixing nip is heated by the fixing belt, and an unfixed toner image borne on the sheet is fixed under heat.

When small sheets are continuously printed by using such a fixing device, the temperature of the longitudinal end portions (non-sheet passing portions) of the fixing belt may rise excessively. The excessive rise in the temperatures of the end portions deteriorates the durability of the fixing belt. Additionally, when a large sheet is printed after the small sheets are printed, the excessive rise in the temperatures of the end portions may cause problems such as an offset and a jam due to sheet winding around the fixing belt.

SUMMARY

This specification describes an improved heating device that includes a heating rotator, a pressing rotator, a heater, a fan, a housing, and a pair of shutters. The pressing rotator is configured to press against the heating rotator to form a nip passing through a recording medium with the heating rotator. The heater is disposed inside the heating rotator. The housing houses the heating rotator and the pressing rotator. The housing has a pair of openings each configured to allow airflow generated by the fan to pass through each of the pair of openings. The pair of shutters are each configured to slide in corresponding one of the pair of openings in a longitudinal direction of the corresponding one of the pair of openings. Each of the pair of shutters is configured to slide between a position at which an outer end portion of the corresponding one of the pair of openings is opened in the longitudinal direction of the corresponding one of the pair of openings and a position at which an inner end portion of the corresponding one of the pair of openings is opened in the longitudinal direction of the corresponding one of the pair of openings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 9 is a table summarizing the positions of the shutters, an effective shielding width, and a blower fan control in FIGS. 7A to 7G.

Figure 1:
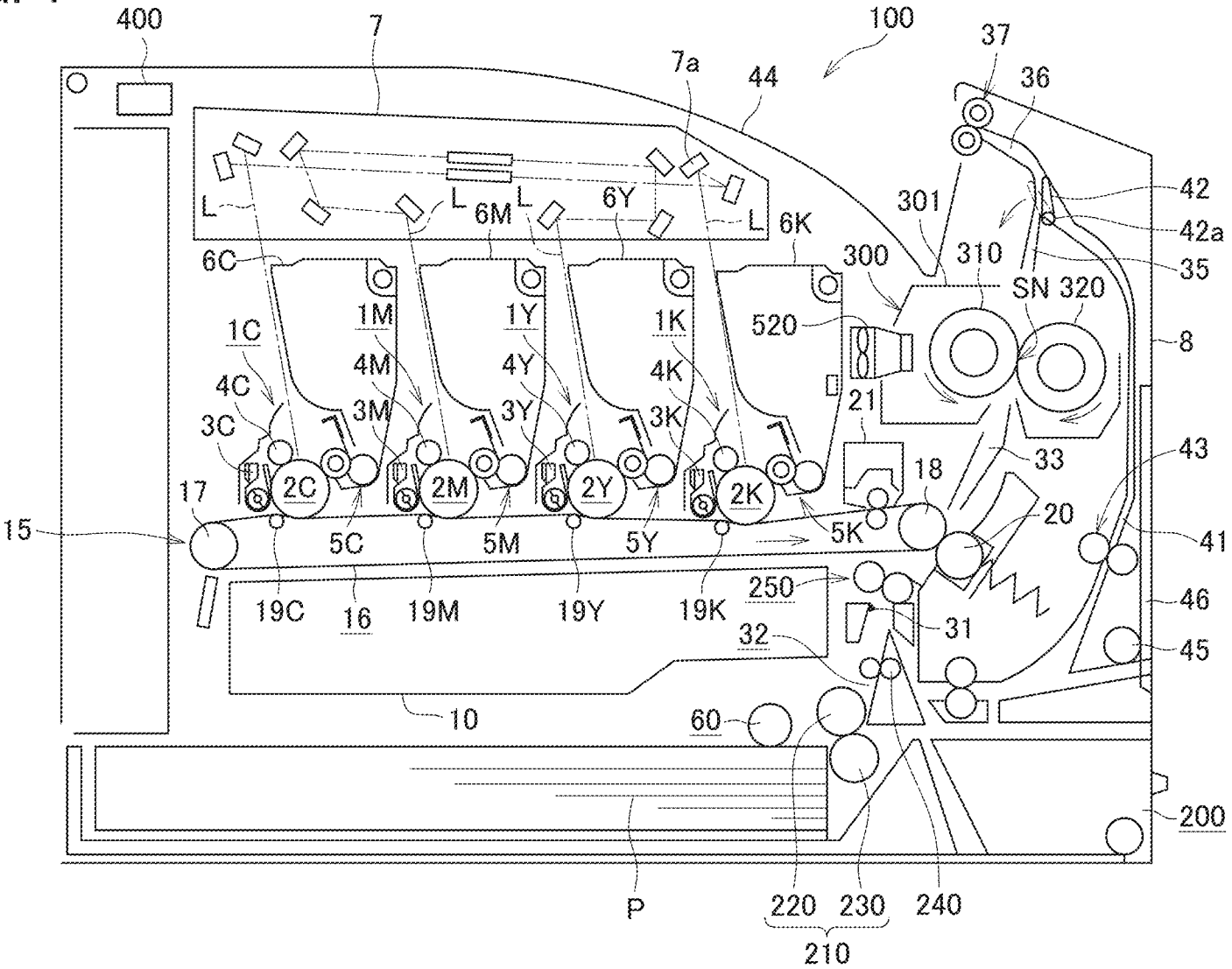
FIG. 1 is a schematic view of a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise. Identical reference numerals are assigned to identical components or equivalents and a description of those components is simplified or omitted.

With reference to drawings, a description is given of a fixing device according to an embodiment of the present disclosure and an image forming apparatus such as a laser printer including the fixing device. The laser printer is just an example of the image forming apparatus, and thus the image forming apparatus is not limited to the laser printer. In other words, the image forming apparatus may be a copier, a facsimile machine, a printer, a plotter, an inkjet recording apparatus, or a multifunction peripheral having at least two of copying, printing, facsimile transmission, plotting, scanning, and inkjet recording capabilities.

The identical or similar parts in each drawing are designated by the same reference numerals, and the duplicate description thereof is appropriately simplified or omitted. Further, size (dimension), material, shape, and relative positions used to describe each of the components and units are examples, and the scope of the present disclosure is not limited thereto unless otherwise specified.

Although a "recording medium" is described as a "sheet" in the following embodiments, the "recording medium" is not limited to the sheet. Examples of the "recording medium" include not only the sheet of paper but also an overhead projector (OHP) transparency sheet, a fabric, a metallic sheet, a plastic film, and a prepreg sheet including carbon fibers previously impregnated with resin.

Examples of the "recording medium" include all media to which developer or ink can be adhered, and so-called recording paper and recording sheets. Examples of the "sheet" include thick paper, a postcard, an envelope, thin paper, coated paper (e.g., coat paper and art paper), and tracing paper, in addition to plain paper.

The term "image formation" used in the following description means not only giving an image such as a character or a figure to a medium but also giving an arbitrary image such as a pattern to the medium.

A configuration of the image forming apparatus according to an embodiment is described below.

Figure 2:
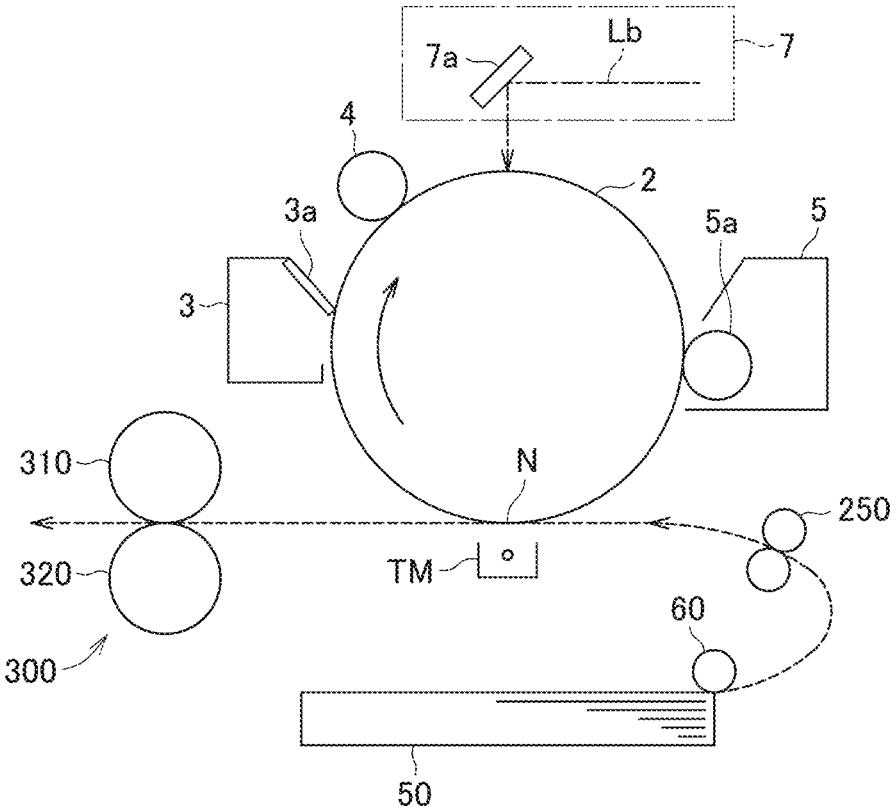
FIG. 2 is a schematic diagram illustrating the principle of how an image forming apparatus operates, according to the embodiment of the present disclosure.

FIG. 1 is a schematic view of a configuration of an image forming apparatus 100 (illustrated as a color laser printer) including a fixing device 300 according to the embodiment of the present disclosure. FIG. 2 is a schematic diagram to simply describe principles of operations in the color laser printer.

The image forming apparatus 100 includes four process units 1K, 1Y, 1M, and 1C as image forming devices. Suffixes, which are K, Y, M, and C, are used to indicate respective colors of toners (black, yellow, magenta, and cyan toners in this example) for the process units. The process units 1K, 1Y, 1M, and 1C form images of color toners of black (K), yellow (Y), magenta (M), and cyan (C) corresponding to color separation components of a color image.

The process units 1K, 1Y, 1M, and 1C respectively include toner bottles 6K, 6Y, 6M, and 6C containing different color toners. The process units 1K, 1Y, 1M, and 1C have a similar structure except the color of toner. Thus, the configuration of the one process unit 1K is described below, and the descriptions of the other process units 1Y, 1M, and 1C are omitted.

The process unit 1K includes an image bearer 2K such as a photoconductor drum, a photoconductor cleaner 3K, and a discharger. The process unit 1K further includes a charging device 4K as a charger that uniformly charges the surface of the image bearer and a developing device 5K as a developing unit that renders visible an electrostatic latent image formed on the image bearer. The process unit 1K is detachably attachable to a main body of the image forming apparatus 100. Consumable parts of the process unit 1K can be replaced at one time.

An exposure device 7 is disposed above the process units 1K, 1Y, 1M, and 1C in the image forming apparatus 100. The exposure device 7 performs writing and scanning based on image data, in other words, irradiates the image bearer 2K with laser light L emitted by a laser diode and reflected by mirrors 7*a* based on the image data.

A transfer device 15 is disposed below the process units 1K, 1Y, 1M, and 1C in the present embodiment. The transfer device 15 corresponds to the transfer unit TM in FIG. 2. Primary transfer rollers 19K, 19Y, 19M, and 19C are disposed opposite the image bearers 2K, 2Y, 2M, and 2C, respectively, in contact with an intermediate transfer belt 16.

The intermediate transfer belt 16 is entrained around the primary transfer rollers 19K, 19Y, 19M, and 19C, a drive roller 18, and a driven roller 17 and is rotated. A secondary transfer roller 20 is disposed opposite the drive roller 18 to contact the intermediate transfer belt 16. Note that, when the image bearers 2K, 2Y, 2M, and 2C serve as primary image bearers to bear images of the respective colors, the intermediate transfer belt 16 serves as a secondary image bearer to bear a composite image in which the images on the respective image bearers 2K, 2Y, 2M, and 2C are superimposed one on another.

A belt cleaner 21 is disposed downstream from the secondary transfer roller 20 in a direction of rotation of the intermediate transfer belt 16. A cleaning backup roller is disposed opposite the belt cleaner 21 via the intermediate transfer belt 16.

A sheet feeder 200 including a tray loaded with sheets P is disposed in a lower portion of the image forming apparatus 100. The sheet feeder 200 serves as a recording-medium supply device and can store a bundle of a large number of sheets P as recording media. The sheet feeder 200 is integrated as a single unit together with a sheet feed roller 60 and a roller pair 210 as a conveyor for the sheets P.

The sheet feeder 200 is detachably inserted in the main body of the image forming apparatus 100 to supply the sheet. The sheet feed roller 60 and the roller pair 210 are disposed at an upper portion of the sheet feeder 200 and convey the uppermost one of the sheets P in the sheet feeder 200 to a sheet feeding path 32.

A registration roller pair 250 as a separation conveyor is disposed near the secondary transfer roller 20 and upstream from the secondary transfer roller 20 in a sheet conveyance direction and can temporarily stop the sheet P fed from the sheet feeder 200. Temporarily stopping the sheet P causes slack on the leading-edge side of the sheet P and corrects a skew of the sheet P.

A registration sensor 31 is disposed immediately upstream from the registration roller pair 250 in the sheet conveyance direction and detects passage of a leading edge of the sheet. When a predetermined time passes after the registration sensor 31 detects the passage of the leading edge of the sheet, the sheet contacts the registration roller pair 250 and temporarily stops.

Conveyance rollers 240 are disposed downstream from the sheet feeder 200 to convey the sheet, which has been conveyed to the right side from the roller pair 210, upward. As illustrated in FIG. 1, the conveyance rollers 240 conveys the sheet to the registration roller pair 250 upward.

The roller pair 210 includes a pair of an upper roller and a lower roller. The roller pair 210 can adopt a friction reverse roller (feed and reverse roller (FRR)) separation system or a friction roller (FR) separation system.

In the FRR separation system, a separation roller (a return roller) is applied with a certain amount of torque in a counter sheet feeding direction from a driving shaft via a torque limiter and pressed against a feed roller to separate sheets in a nip between the separation roller and the feed roller. In the FR separation system, the separation roller (a friction roller) is supported by a secured shaft via a torque limiter and pressed against a feed roller to separate sheets in a nip between the separation roller and the feed roller.

The roller pair 210 in the present embodiment has a configuration of the FRR separation system. That is, the roller pair 210 includes a feed roller 220 and a separation roller 230. The feed roller 220 is an upper roller of the roller pair 210 and conveys a sheet toward an inner side of the image forming apparatus 100. The separation roller 230 is a lower roller of the roller pair 210. A driving force acting in a direction opposite a direction in which a driving force is given to the feed roller 220 is given to the separation roller 230 by a drive shaft through a torque limiter.

The separation roller 230 is pressed against the feed roller 220 by a pressing member such as a spring. A clutch transmits the driving force of the feed roller 220 to the sheet feed roller 60, and the sheet feed roller 60 rotates left in FIG. 1.

The registration roller pair 250 sends the sheet P that contacts the registration roller pair 250 and has the slack on the leading-edge side of the sheet P toward the secondary transfer nip between the secondary transfer roller 20 and the drive roller 18, which is illustrated as a transfer nip N in FIG. 2, at a suitable timing to transfer the toner image formed on the intermediate transfer belt 16 onto the sheet P. A bias applied at the secondary transfer nip electrostatically transfers the toner image formed on the intermediate transfer belt 16 onto the fed sheet P at a desired transfer position with high accuracy.

A post-transfer conveyance path 33 is disposed above the secondary transfer nip between the secondary transfer roller 20 and the drive roller 18. The fixing device 300 is disposed near an upper end of the post-transfer conveyance path 33. The fixing device 300 includes a fixing belt 310 as a heating rotator including a heat generator and a pressure roller 320 as a pressing rotator that rotates while contacting the fixing belt 310 with a predetermined pressure.

A post-fixing conveyance path 35 is disposed above the fixing device 300 and branches into a sheet ejection path 36 and a reverse conveyance path 41 at the upper end of the post-fixing conveyance path 35. At this branching portion, the switching member 42 is disposed and pivots on a pivot shaft 42*a*. At an opening end of the sheet ejection path 36, a pair of sheet ejection rollers 37 is disposed.

The reverse conveyance path 41 begins from the branching portion and converges into the sheet feeding path 32. Additionally, a reverse conveyance roller pair 43 is disposed midway in the reverse conveyance path 41. An upper face of the image forming apparatus 100 is recessed to an inner side of the image forming apparatus 100 and serves as an output tray 44.

A powder container 10 such as a toner container is disposed between the transfer device 15 and the sheet feeder 200. The powder container 10 is removably installed in the main body of the image forming apparatus 100.

The image forming apparatus 100 according to the present embodiment has a predetermined distance from the sheet feed roller 60 to the secondary transfer roller 20 in consideration of the conveyance of the sheet on which the toner image is to be transferred. The powder container 10 is disposed in a dead space caused by the predetermined distance to keep the entire image forming apparatus compact.

A transfer cover 8 is disposed above the sheet feeder 200 and on a front side to which the sheet feeder 200 is pulled out. The transfer cover 8 can be opened to check an interior of the image forming apparatus 100. The transfer cover 8 includes a bypass feed roller 45 for bypass sheet feeding and a bypass feed tray 46 for the bypass sheet feeding.

Next, the principle of the above-described image forming apparatus 100 is described with reference to FIG. 2.

The image forming apparatus 100 includes an image bearer 2 such as a photoconductor drum and a photoconductor cleaner 3. The image forming apparatus 100 further includes a charging device 4 as a charger that uniformly charges the surface of the image bearer, a developing device 5 that renders visible an electrostatic latent image on the image bearer, a transfer device TM disposed under the image bearer 2, the discharger, and the like.

An exposure device 7 is disposed above the image bearer 2. The exposure device 7 performs writing and scanning based on image data, that is to say, irradiates the image bearer 2 with laser light Lb emitted by a laser diode based on image data and reflected by a mirror 7*a*.

A sheet feeder 200 including a tray loaded with sheets P is disposed in a lower portion of the image forming apparatus 100. The sheet feeder 200 serves as a recording-medium supply device and can store a bundle of a large number of sheets P as recording media. The sheet feeder 200 is integrated as a single unit together with the sheet feed roller 60 as the conveyor for the sheets P.

Downstream from the sheet feed roller 60, a registration roller pair 250 as a separation and conveyance means is disposed. The registration roller pair 250 temporarily stops the sheet P fed from the sheet feeder 200. Temporarily stopping the sheet P causes slack on the leading-edge side of the sheet P and corrects a skew of the sheet P.

The registration roller pair 250 sends the sheet P contacting the registration roller pair 250 and having the slack on the leading-edge side toward a transfer nip N of the transfer device TM at a timing to suitably transfer a toner image on the image bearer 2 onto the sheet P. A bias applied at the transfer nip N electrostatically transfers the toner image formed on the image bearer 2 onto the sent sheet P at a desired transfer position.

The fixing device 300 is disposed downstream from the transfer nip N. The fixing device 300 includes the fixing belt 310 heated by a heater, and the pressure roller 320 that rotates while contacting the fixing belt 310 with the predetermined pressure. Note that the fixing belt 310 may be replaced by a fixing roller.

Referring to FIG. 1, operations of the image forming apparatus 100 according to the present embodiment are described below.

First, operations of a simplex or single-sided printing are described.

Referring to FIG. 1, the sheet feed roller 60 rotates in response to a sheet feeding signal from a controller 400 as circuitry of the image forming apparatus 100. The sheet feed roller 60 separates the uppermost sheet from a bundle of sheets P (also referred to as sheet bundle) loaded in the sheet feeder 200 and feeds the uppermost sheet to the sheet feeding path 32.

When the leading edge of the sheet P, which has been fed by the sheet feed roller 60 and the roller pair 210, reaches a nip of the registration roller pair 250, the sheet P is slackened and temporarily stopped by the registration roller pair 250. The registration roller pair 250 corrects the skew on the leading-edge side of the sheet P and rotates in synchronization with an optimum timing so that a toner image formed on the intermediate transfer belt 16 is transferred onto the sheet P.

When the sheet P is fed from the bypass feed tray 46, sheets P of the sheet bundle loaded on the bypass feed tray 46 are fed one by one from the uppermost sheet of the sheet bundle by the bypass feed roller 45. Then, the sheet P passes a part of the reverse conveyance path 41 and is conveyed to the nip of the registration roller pair 250. The subsequent operations are the same as the sheet feeding operations from the sheet feeder 200.

As to image formation, operations of the process unit 1K are described as representative, and descriptions of the other process units 1Y, 1M, and 1C are omitted here. First, the charging device 4K uniformly charges the surface of the image bearer 2K to high potential. The exposure device 7 irradiates the surface of the image bearer 2K with laser light L according to image data.

The surface of the image bearer 2K irradiated with the laser light L has an electrostatic latent image due to a drop in the potential of the irradiated portion. The developing device 5K includes a developer bearer to bear developer including toner and transfers unused black toner supplied from the toner bottle 6K onto the irradiated portion of the surface of the image bearer 2K having the electrostatic latent image through the developer bearer.

The image bearer 2K to which the toner has been transferred forms (develops) a black toner image on the surface of the image bearer 2K. The black toner image formed on the image bearer 2K is transferred onto the intermediate transfer belt 16.

The photoconductor cleaner 3K removes residual toner remaining on the surface of the image bearer 2K after an intermediate transfer operation. The removed residual toner is conveyed by a waste toner conveyor and collected to a waste toner container in the process unit 1K. The discharger discharges the remaining charge on the image bearer 2K from which the remaining toner is removed by the photoconductor cleaner 3K.

Similarly, toner images are formed on the image bearers 2Y, 2M, and 2C in the process units 1Y, 1M, and 1C for the colors, and color toner images are transferred to the intermediate transfer belt 16 such that the color toner images are superimposed on one on another.

The intermediate transfer belt 16 on which the color toner images are transferred and superimposed travels such that the color toner images reach the secondary transfer nip between the secondary transfer roller 20 and the drive roller 18. The registration roller pair 250 rotates to nip the sheet P contacting the registration roller pair 250 at a predetermined timing and conveys the sheet P to the secondary transfer nip of the secondary transfer roller 20 at a suitable timing such that a composite toner image formed by superimposing and transferring the toner images on the intermediate transfer belt 16 is transferred onto the sheet P. In this manner, the composite toner image on the intermediate transfer belt 16 is transferred to the sheet P sent out by the registration roller pair 250.

The sheet P having the transferred composite toner image is conveyed to the fixing device 300 through the post-transfer conveyance path 33. The sheet P conveyed to the fixing device 300 is nipped by the fixing belt 310 and the pressure roller 320. The unfixed toner image is fixed onto the sheet P under heat and pressure in the fixing device 300. The sheet P, on which the composite toner image has been fixed, is sent out from the fixing device 300 to the post-fixing conveyance path 35.

When the fixing device 300 sends out the sheet P, the switching member 42 is at a position at which the upper end of the post-fixing conveyance path 35 is open, as indicated by the solid line of FIG. 1. The sheet P sent out from the fixing device 300 is sent to the sheet ejection path 36 via the post-fixing conveyance path 35. The pair of sheet ejection rollers 37 nips the sheet P sent out to the sheet ejection path 36 and rotates to eject the sheet P to the output tray 44. Then, the single-sided printing is finished.

Next, a description is given of operations of a duplex or double-sided printing. Similar to the single-sided printing described above, the fixing device 300 sends out the sheet P to the sheet ejection path 36. In the duplex printing, the pair of sheet ejection rollers 37 rotates to convey a part of the sheet P outside the image forming apparatus 100.

When the trailing edge of the sheet P passes through the sheet ejection path 36, the switching member 42 pivots on the pivot shaft 42*a* as indicated with a dotted line in FIG. 1A to close the upper end of the post-fixing conveyance path 35. When the upper end of the post-fixing conveyance path 35 is closed, substantially simultaneously, each of the pair of sheet ejection rollers 37 rotates in reverse (in other words, in a direction opposite to the direction to convey a part of the sheet P outside the image forming apparatus 100) to convey the sheet P to an inner side of the image forming apparatus 100, that is, to the reverse conveyance path 41.

The sheet P sent out to the reverse conveyance path 41 reaches the registration roller pair 250 through the reverse conveyance roller pair 43. The registration roller pair 250 sends out the sheet P to the secondary transfer nip at a suitable timing such that the toner image formed on the intermediate transfer belt 16 is transferred onto the other surface of the sheet P to which no toner image has been transferred.

When the sheet P passes through the secondary transfer nip, the secondary transfer roller 20 and the drive roller 18 transfer the toner image to the other surface (back side) of the sheet P to which no toner image has been transferred. The sheet P having the transferred toner image is conveyed to the fixing device 300 through the post-transfer conveyance path 33.

In the fixing device 300, the sheet P is nipped by the fixing belt 310 and the pressure roller 320, and the unfixed toner image are fixed on the back side of the sheet P under heat and pressure. The sheet P having the toner images fixed to both front and back sides of the sheet P in this manner is sent out from the fixing device 300 to the post-fixing conveyance path 35.

When the fixing device 300 sends out the sheet P, the switching member 42 is at a position at which the upper end of the post-fixing conveyance path 35 is open, as indicated by the solid line of FIG. 1. The sheet P sent out from the fixing device 300 is sent to the sheet ejection path 36 via the post-fixing conveyance path 35. The pair of sheet ejection rollers 37 nips the sheet P sent out to the sheet ejection path 36 and rotates to eject the sheet P to the output tray 44. Thus, the duplex printing is finished.

After the toner image on the intermediate transfer belt 16 is transferred onto the sheet P, residual toner remains on the intermediate transfer belt 16. The belt cleaner 21 removes the residual toner from the intermediate transfer belt 16. The waste toner conveyor conveys the toner removed from the intermediate transfer belt 16 to the powder container 10, and the toner is collected inside the powder container 10.

Next, a description is given of the fixing device 300 according to the present embodiment of the present disclosure.

Figure 3:
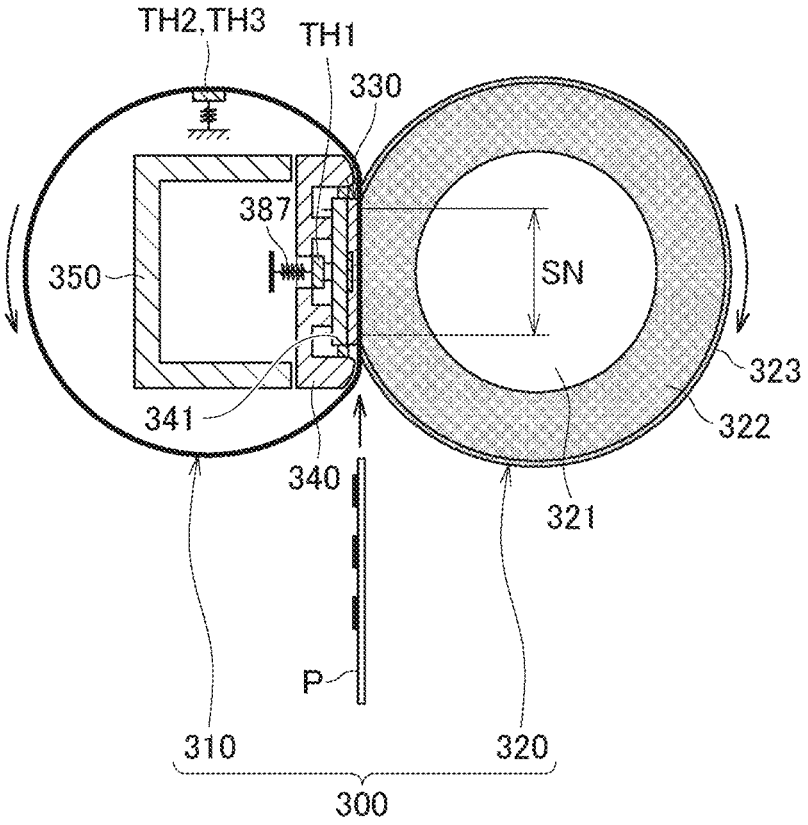
FIG. 3 is a cross-sectional view illustrating a fixing device used in the image forming apparatus in FIG. 1.

As illustrated in FIG. 3, the fixing device 300 includes a thin fixing belt 310 having low thermal capacity and a pressure roller 320. The fixing belt 310 includes, for example, a tubular base made of polyimide (PI). The tubular base has an outer diameter of 25 mm and a thickness of from 40 micrometers (μm) to 120 μm.

The fixing device 300 may be a roller fixing system or a belt fixing system in addition to the system using the fixing belt 310 as illustrated in FIG. 3. In any one of the fixing systems, heating small sheets P to fix the toner images onto the small sheets P may cause an excessive temperature rise in a non-sheet passage portion of the heating rotator through which the sheets P do not pass because the sheets P absorb heat of the heater from a sheet passage portion of the heating rotator through which the sheets P pass but do not absorb the heat from the non-sheet passage potion.

The fixing belt 310 includes a release layer serving as an outermost surface layer. The release layer is made of fluororesin, such as tetrafluoroethylene-perfluoroalkylvinylether copolymer (PFA) and polytetrafluoroethylene (PTFE), and has a thickness of from 5 μm to 50 μm to enhance durability of the fixing belt 310 and facilitate separation of the sheet P from the fixing belt 310. An elastic layer made of rubber having a thickness of from 50 to 500 μm may be interposed between the base and the release layer.

The base of the fixing belt 310 may be made of heat-resistant resin such as polyetheretherketone (PEEK) or metal such as nickel (Ni) or stainless steel (Stainless Used Steel, SUS), instead of polyimide. An inner circumferential surface of the fixing belt 310 may be coated with polyimide, PTFE, or the like to produce a slide layer.

A detailed description is now given of a construction of the pressure roller 320. The pressure roller 320 has an outer diameter of 25 mm, for example. The pressure roller 320 includes a cored bar 321, an elastic layer 322, and a release layer 323. The cored bar 321 is solid and made of metal such as iron. The elastic layer 322 coats the cored bar 321. The release layer 323 coats an outer surface of the elastic layer 322. The elastic layer 322 is made of silicone rubber and has, for example, a thickness of 3.5 mm.

Preferably, the release layer 323 is formed by a fluororesin layer having, for example, a thickness of approximately 40 μm on the surface of the elastic layer 322 to enhance releasability. A biasing member presses the pressure roller 320 against the fixing belt 310.

A stay 350 and a heater holder 340 are disposed inside the fixing belt 310 and extend in the axial direction of the fixing belt 310. The stay 350 is made of a metal channel member, and both side plates of the fixing device 300 support both end portions of the stay 350. The stay 350 reliably receives the pressing force of the pressure roller 320 to stably form a fixing nip SN.

The heater holder 340 holds a base 341 of the heater 330 of the fixing device 300 and is supported by the stay 350. Preferably, the heater holder 340 is made of heat-resistant resin having low thermal conduction, such as a liquid crystal polymer (LCP). Such a configuration can reduce heat transfer to the heater holder 340 and effectively heat the fixing belt 310.

The heater holder 340 has a shape that supports two portions of the base 341 near both end portions in a shorter-side direction of the base 341 to avoid contact with a high-temperature portion of the base 341. Thus, the amount of heat flowing to the heater holder 340 can be further reduced to effectively heat the fixing belt 310.

The fixing device 300 includes a thermistor TH1 as a central temperature sensor disposed on the back side of the base 341 to detect temperature of heat generators 372 to 376 of the heater 330 described below. The thermistor TH1 is pressed against the back side of the base 341 by a spring 387. Due to the configuration, the accurate temperature of the heat generators 372 to 376 can be detected.

Additionally, the fixing device 300 includes a thermistor TH2 as a central temperature sensor and a thermistor TH3 as an end portion temperature sensor. The thermistors TH2 and TH3 detect temperatures of portions of the fixing belt 310 on an inner surface of the fixing belt 310 and the portions downstream from the fixing nip SN. The thermistor TH2 faces a center portion of the fixing belt 310 in the longitudinal direction of the heater 330, which is similar to the thermistor TH1. The thermistor TH3 faces an end portion (that is a non-sheet passing portion) of the fixing belt in the longitudinal direction of the heater 330.

The thermistors TH1 and TH2 face the center portion of the fixing belt corresponding to the center of the small sheet in a width direction of the small sheet. In addition, the thermistors TH3 faces the non-sheet passing portion of the fixing belt that is an outside of a portion of the fixing belt corresponding to the small sheet in the width direction of the large sheet. The non-sheet passing portion of the fixing belt is a portion on which the sheet passing through the fixing device does not contact the fixing belt. Based on the temperature data from the thermistors TH1 to TH3, the controller 400 as the circuitry controls electric power supplied to the heater 330 and a drive motor M1 that drives shutters 307 described below to effectively prevent the temperature of the non-sheet passing portion of the fixing belt from rising.

A thermistor disposed opposite the outer peripheral surface of the pressure roller 320 may be substituted for the thermistors TH1 to TH3. Since disposing the thermistor facing the pressure roller 320 means disposing the thermistor outside the fixing belt 310, maintenance of the thermistor is easy. The fixing device 300 may be various types of fixing devices, and the fixing device 300 in FIG. 3 described above is just one example.

Next, the heater 330 is described.

Figure 4:
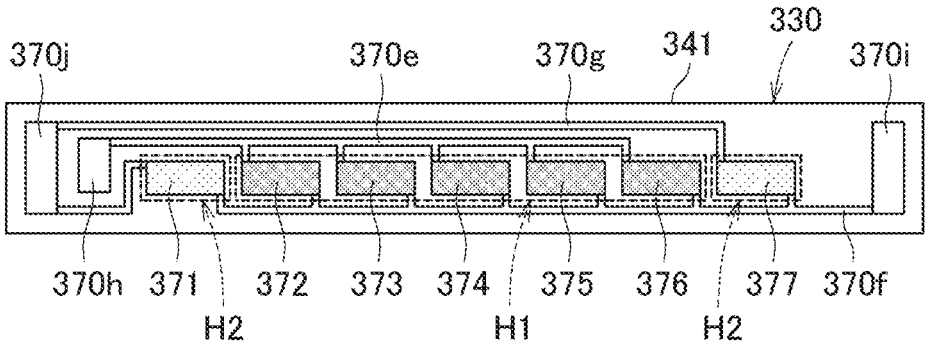
FIG. 4 is a plan view of a heater.

FIG. 4 illustrates an example of the heater 330 described above. The heater 330 includes three electrodes 370*h*, 370*i*, and 370*j* disposed at both ends of the base 341, and seven heat generators 371 to 377 disposed between the electrodes in the longitudinal direction of the base 341. Changing connections between an alternating current (AC) power supply and the three electrodes 370*h*, 370*i*, 370*j* enables selecting the following three heat generation patterns.

Heat generation pattern 1: Central heat generators 372 to 376 generate heat (for example, when the fixing device heats the small sheet such as an A4 sheet, that is, a sheet having A4 size).

Heat generation pattern 2: All heat generators 371 to 377 generate heat (for example, when the fixing device heats the large sheet such as an A3 sheet, that is, a sheet having A3 size).

Heat generation pattern 3: Only end heat generators 371 and 377 generate heat (for example, to prevent the temperatures of end portions of the fixing belt from lowering when the fixing device heats the A3 sheet).

The central heat generators 372 to 376 are referred to as a central heater H1, and the heat generators 371 and 377 at both end portions of the heater 330 are referred to as end heaters H2. The central heater H1 and the end heaters H2 are arranged so as not to overlap each other when viewed from a short-side direction orthogonal to the longitudinal direction of the heater 330.

A boundary position between the central heater H1 and each of the end heaters H2 in the longitudinal direction of the heater 330 may be arbitrarily set, but is generally set to a position corresponding to an edge of the small sheet that is frequently used. For example, the boundary position between the central heater H1 and each of the end heaters H2 described in the present embodiment corresponds to an edge of the A4 sheet that is fed in portrait orientation.

Five heat generators 372 to 376 at the center portion in the longitudinal direction of the heater 330 are coupled in parallel to a first electrode 370*h* and a second electrode 370*i* via conductors 370*e* and 370*f* having lower resistance than the heat generators. Two heat generators 371 and 377 at both end portions in the longitudinal direction are coupled in parallel to the second electrode 370*i* and a third electrode 370*j* via conductors 370*f* and 370*g* having lower resistance than the heat generators 371 and 377.

A second electrode 370*i* on a right end portion of the heater 330 is always connected to the AC power supply, and a first electrode 370*h* and a third electrode 370*j* on a left end portion of the heater 330 are selectively connected to the AC power supply by switching of switches. Thus, the above-described three heat generation patterns 1 to 3 can be selected.

In the above-described heater 330 having the three heat generation patterns that can be selected, for example, a length in the longitudinal direction of the five heat generators 372 to 376 that are continuously arranged at the center portion in the longitudinal direction of the heater 330 is set to be a width of A4 sheet, and a length of all seven the heat generators 371 to 377 including the heat generators at both end portions is set to be a width of A3 sheet. Appropriately controlling heat generations of the heat generators 371 to 377 enables uniformly heating the A4 sheet and the A3 sheet.

A heat generation control method for the heat generators 371 to 377 is generally a duty cycle method in which the controller 400 changes a duty cycle that is a ratio of time turning on the heat generators to a predetermined time to get a suitable heat generation amount. The duty cycle is adjusted by controlling the phase of the AC power supply by a triac as a control means. The current is zero at a 0% duty cycle and is a maximum value at a 100% duty cycle.

The heat generators 371 to 377 may be, for example, positive temperature coefficient (PTC) elements. The PTC element is made of a material having a positive temperature resistance coefficient, and has a characteristic that the resistance value increases as the temperature T increases (the current I decreases and the heater output decreases). The temperature coefficient of resistance (TCR) may be, for example, 1500 parts per million (PPM).

The heat generators 371 to 377 are formed on the base 341. The base 341 is an elongated thin metal plate member coated with an insulating material. Low-cost aluminum or stainless steel is preferable as the material of the base 341. However, the material of the base 341 is not limited to metal and alternatively may be a ceramic, such as alumina or aluminum nitride, or a nonmetallic material having excellent thermal resistance and insulating properties, such as glass or mica.

To improve thermal uniformity of the heater 330 and image quality, the base 341 may be made of a material having high thermal conductivity, such as copper, graphite, or graphene. The heater 330 according to the present embodiment uses an alumina base having a lateral width of 8 mm, a longitudinal width of 270 mm, and a thickness of 1.0 mm.

Figure 5A:
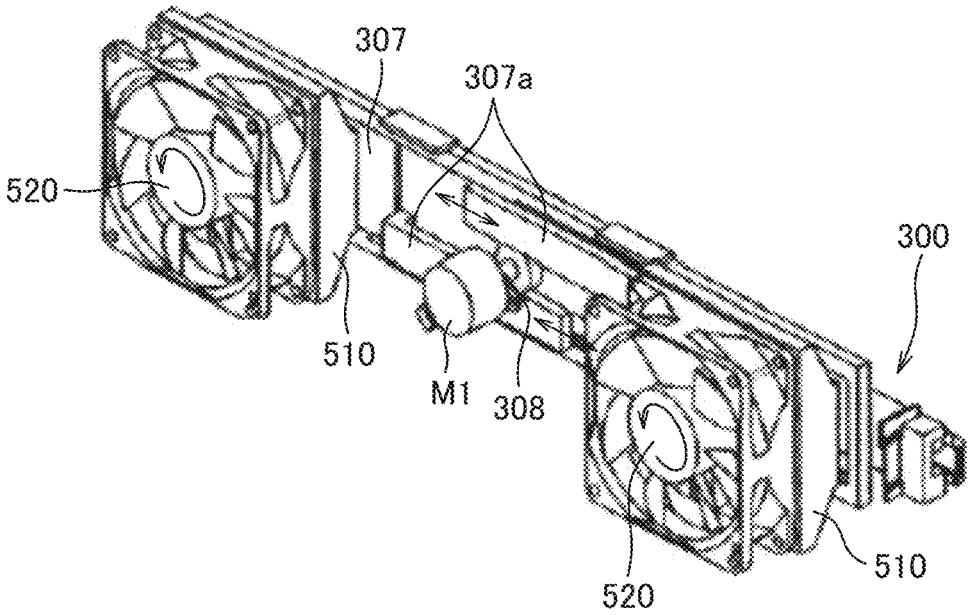
FIG. 5A is a perspective view of shutters and blower fans to be attached to a housing of the fixing device according to the embodiment of the present disclosure.

Next, a cooling device of the fixing device 300 is described with reference to FIGS. 1, 5A, and 5B.

As illustrated in FIG. 1, a housing (a cover) 301 houses the fixing belt 310 and the pressure roller 320 for thermal insulation and heat retention, and blower fans 520 are disposed on a side of the housing 301. The sheet bearing the toner image enters at a lower inlet of the housing 301, passes through the fixing nip SN, and exits from an upper outlet of the housing 301.

Figure 5B:
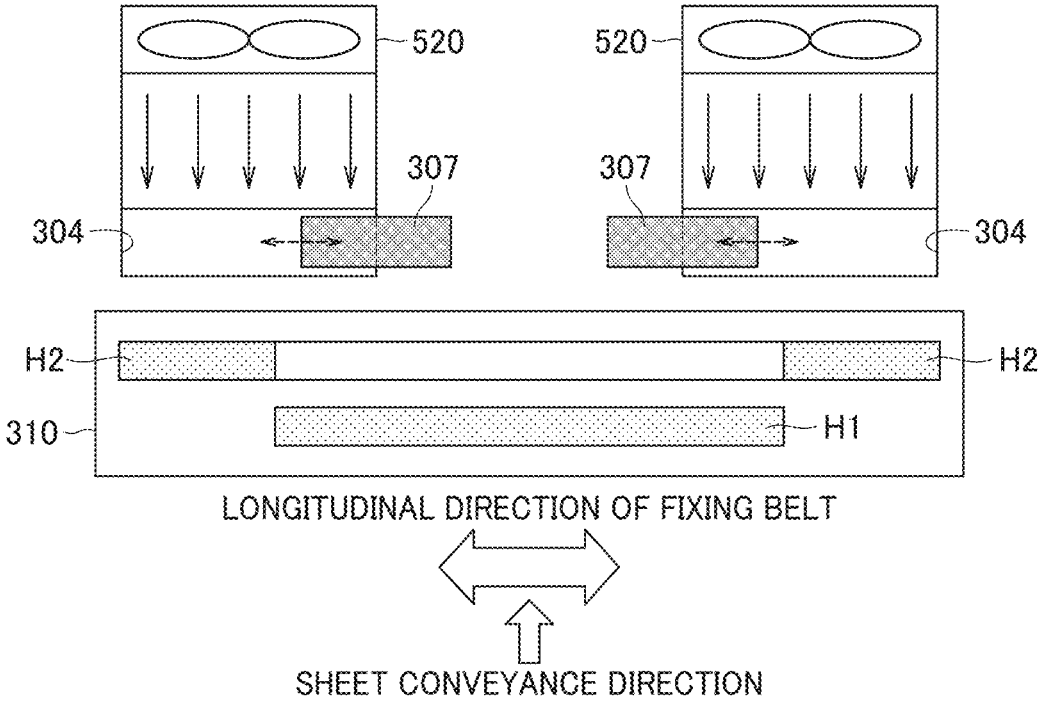
FIG. 5B is a schematic diagram illustrating an arrangement relationship among heaters, openings, and shutters of the fixing device of FIG. 5A.

As illustrated in FIG. 5B, the housing 301 has rectangular openings 304 formed on the side of housing 301. The openings 304 are formed as a pair of openings at both end portions of the housing 301 in the longitudinal direction of the housing 301. The openings 304 open toward both end portions of the fixing belt 310 in the longitudinal direction of the fixing belt 310 (that are non-sheet passing portions when the A4 sheet passes through the fixing device and portions heated by the end heaters H2) and both end portions of the central portion of the fixing belt 310 heated by the central heater H1 in the longitudinal direction of the fixing belt 310.

The blower fans 520 disposed outside the openings 304 supply cooling airflow to the openings 304 through ducts. Combinations of rotation speeds of the blower fans 520 and opening degrees (that is, shielding widths) of the shutters 307 can efficiently prevent the temperature rise of the non-sheet passing portions of the fixing belt 310.

FIG. 5B is a schematic diagram illustrating a positional relationship between the openings 304 and the shutters 307 with respect to the central heater H1 (that is the heat generators 372 to 376) and the end heaters H2 (that is the heat generators 371 and 377) in the heater 330 of FIG. 4. As can be seen from FIG. 5B, the openings 304 open to face the end heaters H2 and both end portions of the central heater H1. In other words, the openings 304 cover the non-sheet passing portions of the fixing belt 310 in many cases when a plurality of sizes of sheets pass through the fixing device 300. Note that FIG. 5B illustrates heat generation areas of the end heaters H2 shifted from a heat generation area of the central heater H1 in the sheet conveyance direction inside the loop of the fixing belt 310, but, as is clear from FIG. 4, the heat generation areas of the end heaters H2 and the heat generation area of the central heater H1 may be arranged in the longitudinal direction of the base 341, which is the same in FIGS. 7A to 7G and FIG. 8.

As illustrated in FIG. 5B, a width of each of a pair of left and right shutters 307 in the longitudinal direction of the fixing belt 310 is shorter than an opening width of each of the openings 304 in the longitudinal directions of the openings 304. The shutter 307 is configured to be freely movable in a shutter movement range from an inner end portion of the opening 304 to an outer end portion of the opening 304 in the longitudinal direction of the opening 304, and can partially shield an opening area of the opening 304 within the shutter movement range.

Although a size of the non-sheet passing portion in which the temperature rise differs depending on the sheet size, freely changing a shield position of the shutter 307 in the shutter movement range from the inner end portion of the opening 304 to the outer end portion of the opening 304 can effectively prevent the temperature rise in the non-sheet passing portion of the fixing belt 310 regardless of the sheet size.

Next, a driving mechanism of the shutters 307 is described.

The pair of left and right shutters 307 are disposed so as to be slidable in the longitudinal direction of the fixing device 300. As illustrated in FIG. 5A, each shutter 307 includes a rack 307*a* extending toward the center of the fixing device 300 in the longitudinal direction of the fixing device 300, and the rack 307*a* meshes with a pinion 308 disposed at the center of the fixing device in the longitudinal direction of the fixing device 300. A motor M1 drives the pinion 308, and the pinion 308 moves the left and right shutters 307 to approach or separate from each other, thereby opening or closing the opening 304.

Excessive heat causes the excessive temperature rise at the end portion of the fixing belt 310. Just moving the shutter 307 to open a half of the opening 304 or all of the opening 304 can discharge the excessive heat outside. In the present embodiment, in order to enhance the cooling effect cooling the end portion of the fixing belt 310, each of the blower fans 520 is disposed outside the shutter 307, that is, so as to face the opening 304 via the shutter 307, as illustrated in FIGS. 5A and 5B.

The blower fans 520 forcibly blow cooling air into the housing 301 toward the end portions of the fixing belt 310, and the cooling airflow effectively cools the end portion of the fixing belt 310 and can prevent the excessive temperature rise in the end portions. The air blown into the housing 301 is warmed by the end portion of the fixing belt 310 and discharged upward.

The warm air discharged upward as described above can be effectively used to prevent condensation on the branching portion. As illustrated in FIG. 1, disposing the switching member 42 that guides the sheet to the reverse conveyance path 41 during the duplex printing above the fixing device 300 can prevent condensation on the switching member 42. In order to effectively prevent the condensation, the switching member 42 is preferably disposed vertically above the opening 304.

Next, positional relationships between the shutters 307 and sheets having different sheet widths are described.

Figure 6A:
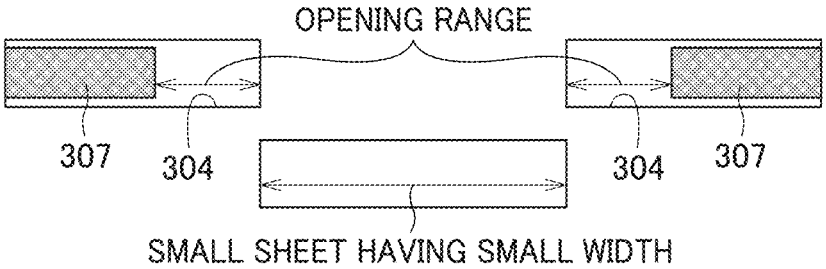
FIG. 6A is a schematic diagram illustrating a relationship between opening ranges of the openings and a sheet width of a small sheet.
Figure 6B:
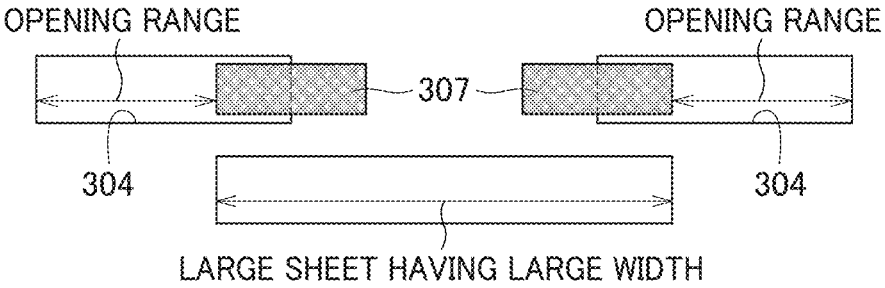
FIG. 6B is a schematic diagram illustrating a relationship between opening ranges of the openings and a sheet width of a large sheet.

FIGS. 6A and 6B are schematic diagrams illustrating positions of the shutters 307 sliding according to the size of the sheet width. As illustrated in FIG. 6A, the shutters 307 are moved to the outer end portions of the openings 304 in the longitudinal directions of the openings 304 when a small sheet having a small sheet width passes through the fixing device 300. Moving the shutters 307 as described above sets opening ranges of openings 304 close to (or adjacent to) both ends of the small sheet, respectively. As a result, the cooling airflow supplied from the blower fans 520 efficiently cools the non-sheet passing portions of the fixing belt 310 outside both ends of the small sheet.

Figure 7A:
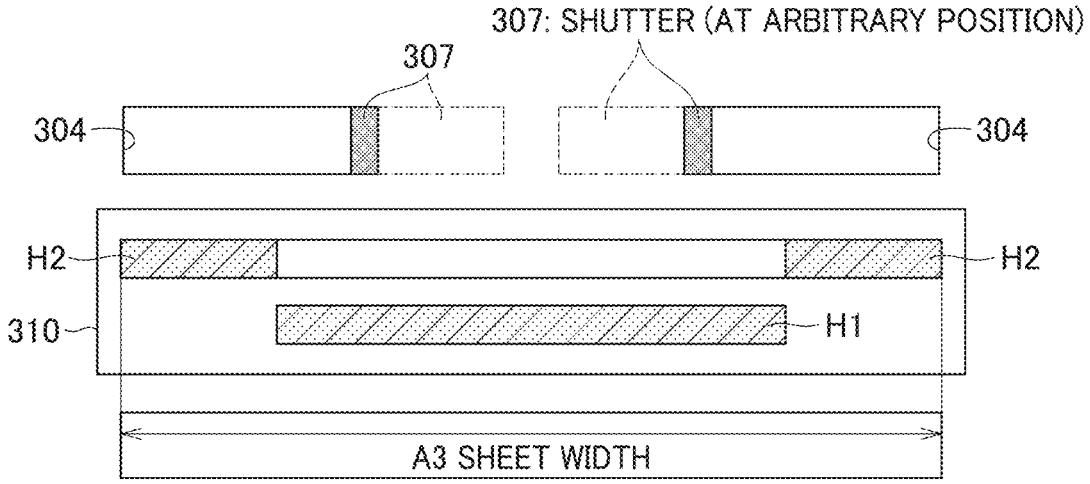
FIG. 7A is a schematic diagram illustrating a positional relationship between the shutters and the haters heating an A3 sheet.
Figure 7B:
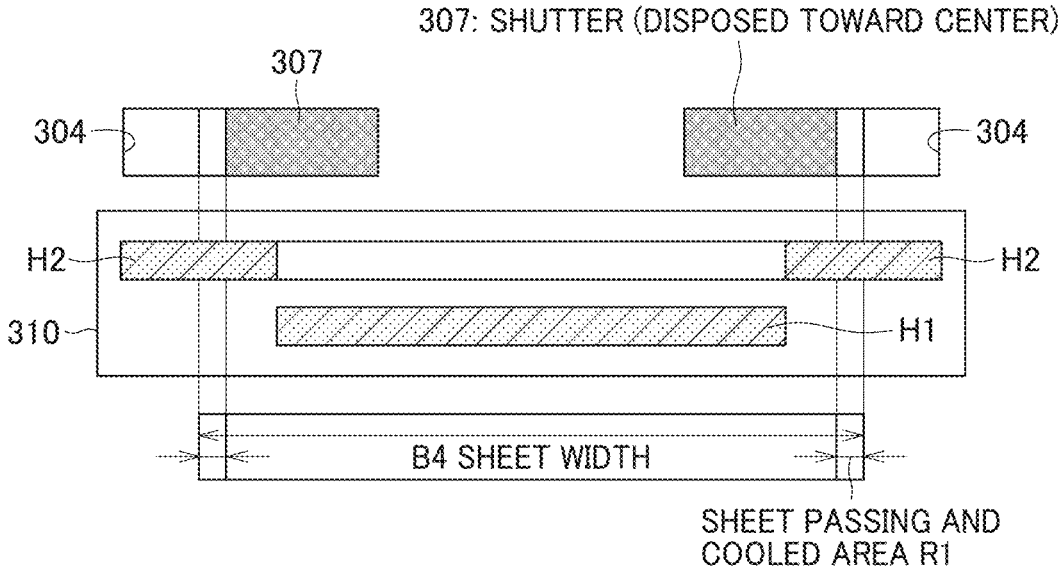
FIG. 7B is a schematic diagram illustrating a positional relationship between the shutters and the haters heating a B4 sheet.
Figure 7C:
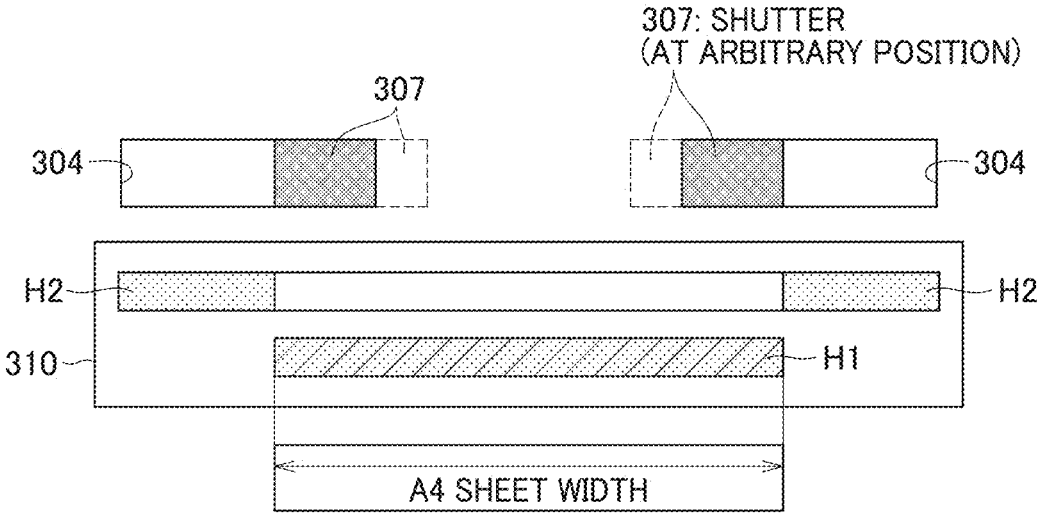
FIG. 7C is a schematic diagram illustrating a positional relationship between the shutters and the haters heating an A4 sheet.
Figure 7D:
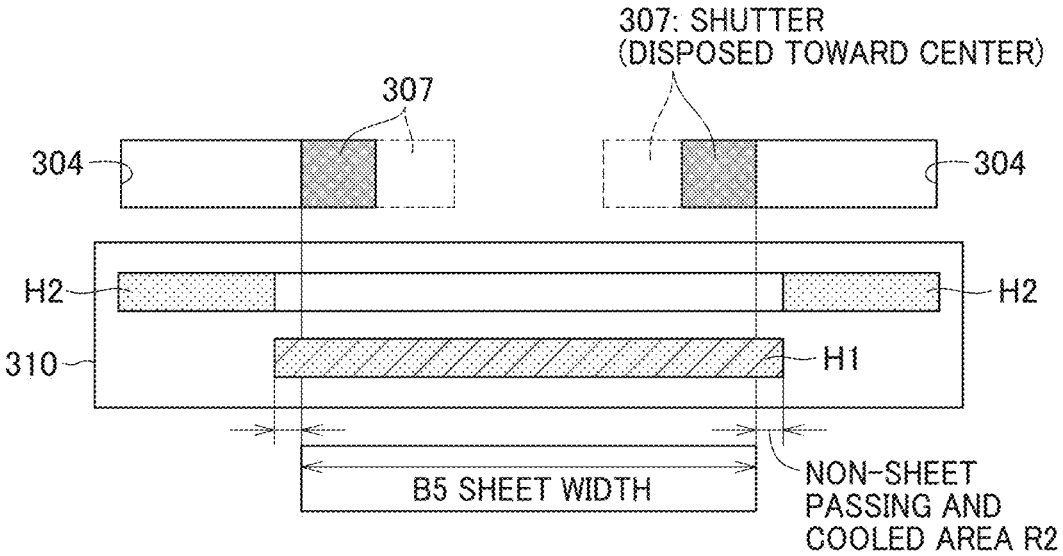
FIG. 7D is a schematic diagram illustrating a positional relationship between the shutters and the haters heating a B5 sheet.
Figure 7E:
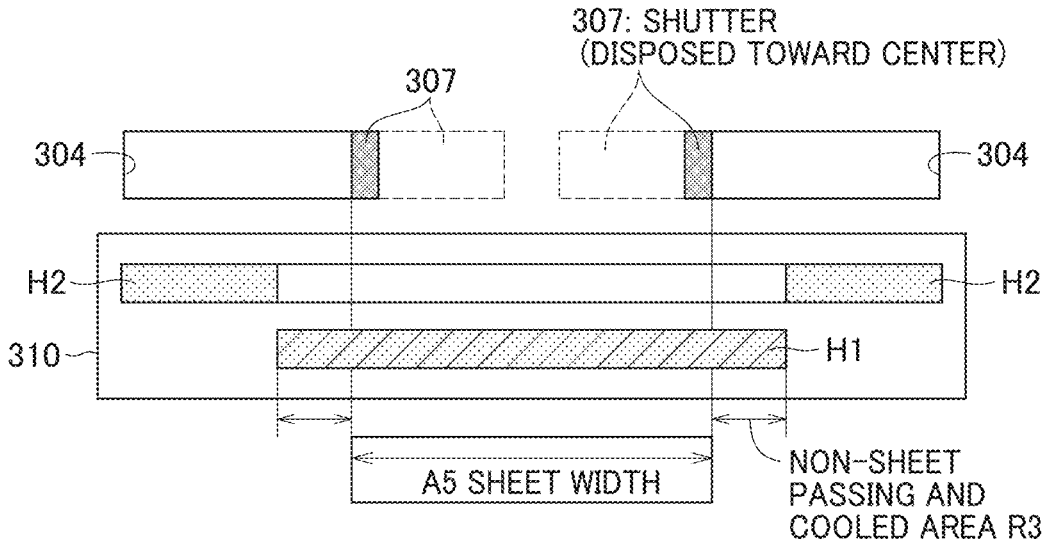
FIG. 7E is a schematic diagram illustrating a positional relationship between the shutters and the haters heating a A5 sheet.
Figure 7F:
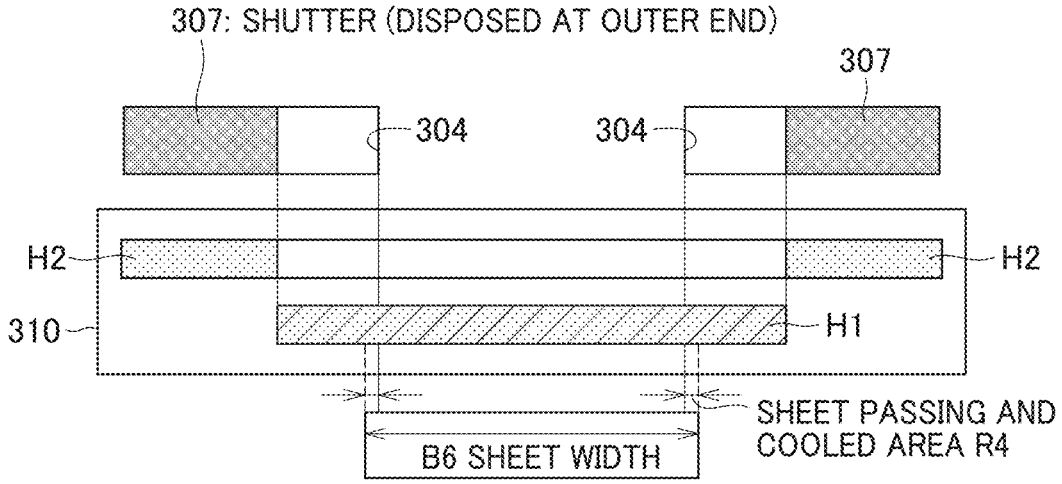
FIG. 7F is a schematic diagram illustrating a positional relationship between the shutters and the haters heating a B6 sheet.

In a fixing device according to a comparative embodiment, openings are fully opened to cool the non-sheet passing portions of the fixing belt when the small sheet having the width smaller than a width of the heat generation area of the central heater H1 in the longitudinal direction of the central heater H1 passes through the fixing device. However, in the fixing device 300 according to the present embodiment, the shutters 307 slide to change the positions of the shutters 307, that is, the shield ranges of the shutters 307 when a range facing the central heater H1 in the non-sheet passing portion is small as illustrated in FIGS. 7D and 7E and when the range facing the central heater H1 in the non-sheet passing portion is large as illustrated in FIGS. 7F and G. With reference to FIGS. 7D to 7G, the present embodiment is described below. Changing the positions of the shutters 307, that is, the shield ranges of the shutters 307 as described above restricts a preferred area of each opening 304 through which the cooling airflow from the blower fan 520 passes to improve cooling efficiency.

In addition, as illustrated in FIG. 6B, the shutters 307 are moved to the inner end portions of the openings 304 in the longitudinal directions of the openings 304 when the large sheet having the large sheet width passes through the fixing device 300. Moving the shutters 307 as described above forms the opening ranges of the openings 304 close to (or adjacent to) both ends of the large sheet. As a result, the cooling airflow supplied from the blower fans 520 efficiently cools the non-sheet passing portions of the fixing belt 310 outside both ends of the large sheet.

With reference to FIGS. 7A to 7G, the following describes control of the shutters 307, the blower fans 520, and the heaters H1 and H2 when sheets having various sizes (ex. A3 size to A6 size) pass through the fixing device.

Sheet sizes described in the present embodiments are A size and B size that are generally used in Japan, but a sheet size in the present disclosure is not limited to this. In the following descriptions, the sheet is fed in portrait orientation.

The blower fan 520 has three operation modes: high-speed rotation mode with high cooling capacity, low-speed rotation mode with low cooling capacity, and stop mode when cooling is unnecessary. In FIGS. 7A to 7G, a dark halftone area is an effective shield range that is an effective shield width in which the shutter 307 covers the inside of the opening 304.

When the A3 sheet (that is the largest sheet size in the image forming apparatus according to the present embodiment) passes through the fixing device 300, the heaters H1 and H2 are energized. FIG. 7A is a schematic diagram illustrating a positional relationship between the shutters and the heaters heating the A3 sheet.

Hatching of the heater H1 and the heater H2 in FIG. 7A means that each heater is energized (the same applies to FIGS. 7B to 7G described below). When the A3 sheet passes through the fixing device 300, the controller 400 as the circuitry stops the blower fan 520 and does not move the shutters 307. In other words, the shutters 307 are at arbitrary slide positions. Since the sheet width coincides with the heating region that the heaters H1 and H2 heats the fixing belt 310, the local excessive temperature rise at the end portion of the fixing belt 310 does not occur.

Therefore, the controller 400 does not drive the blower fan 520. Since the blower fan 520 is stopped, the cooling air does not flow through the opening 304.

The controller 400 does not control driving the shutter 307. The shutter 307 may be at any slide position, in other words, at an arbitrary position. In the embodiment illustrated in FIG. 7A, the shutter 307 is at a position closest to the center of the heater H1, but the controller 400 may freely determine the slide position of the shutter 307 in accordance with an operation of the fixing device. Note that the controller 400 may perform the same control for a sheet having the double-letter size as that for the A3 sheet described above.

When the B4 sheet passes through the fixing device 300, the heaters H1 and H2 are energized. FIG. 7B is a schematic diagram illustrating a positional relationship between the shutters and the heaters heating the B4 sheet.

The controller 400 sets the blower fan 520 to the low-speed rotation mode at the start of sheet conveyance, and switches to the high-speed rotation mode in the middle when the number of B4 sheets passing through the fixing device 300 is large. The controller 400 sets the shutter 307 to be at the inner end portion of the opening 304 in the longitudinal direction of the opening 304 (that is, to be disposed toward the center of the fixing belt 310).

If the outer ends of the shutters 307 are positioned at both ends of the B4 sheet in a width direction of the B4 sheet in FIG. 7B, each of the shutters 307 covers an entire range of the opening 304 facing the B4 sheet. In this case, the controller 400 may set the blower fan 520 to the high-speed rotation mode. In the above, "the outer ends of the shutters 307 are positioned at both ends of the B4 sheet" means that the outer ends of the shutters 307 coincide with both ends of the B4 sheet in the width direction of the B4 sheet when viewed in a short-side direction of the heater H1, H2, or the fixing belt 310.

However, when a pair of the shutters 307 as in the present embodiment is moved based on various sheet sizes in the width direction of the sheets, the outer ends of the shutters 307 are not positioned at both ends of a sheet having at least any one of sheet sizes in the width direction larger than the width of the heat generation area of the central heater H1 in the longitudinal direction of the central heater H1. In the present embodiment, it is assumed that the outer ends of the shutters 307 do not coincide with both ends of the B4 sheet in the width direction as a result of optimization of the sizes of the shielding widths of the shutters 307 for the various sheet sizes.

In other words, the following description assumes a case in which the shielding width of the shutters 307 is slightly smaller than the width of the B4 sheet as illustrated in FIG. 7B. In this case, the outer ends of the shutters 307 disposed toward the center of the fixing belt 310 are positioned at positions inside and near the both ends of the B4 sheet in the width direction of the B4 sheet. Similar to the above description, "the outer ends of the shutters 307 are positioned at positions" means that the outer ends of the shutters 307 coincide with the positions when viewed in the short-side direction of the heater H1, H2, or the fixing belt 310.

The length from one end of the B4 sheet in the width direction of the B4 sheet to one of the positions inside and near the both ends of the B4 sheet depends on the result of optimization of the sizes of the shielding widths of the shutters 307 for the various sheet sizes. In other words, the positions inside and near the both ends of the B4 sheet are determined so that the control of the blower fan 520 as a cooling fan can maintain temperatures of sheet passing and cooled areas R1 within a fixing temperature tolerance range as described below.

Each of the sheet passing and cooled areas R1 is indicated by a line sandwiched by two arrows facing each other in FIG. 7B. Because of a shortage of the shielding width of the shutters 307, the cooling airflow from the blower fan 520 cools the sheet passing and cooled area R1. The sheet passing and cooled area is an area of the fixing belt 310 that contacts the sheet and is cooled by the cooling airflow. In this case, as illustrated in FIG. 8(*e*), applying the cooling air to an end portion of the fixing belt 310 may cause a shortage of a fixing heat amount (in other words, a temperature drop) because the temperatures of the end portion of the fixing belt 310 and an end portion of the sheet is low immediately after the start of sheet conveyance.

Therefore, immediately after the start of sheet conveyance and before the temperature rise of the non-sheet passing portion, the controller 400 sets the blower fan 520 to the low-speed rotation mode or the stop mode. When the temperature of the non-sheet passing portion rises after a large number of sheets have passed through the fixing device 300, the controller 400 switches the blower fan 520 to the high-speed rotation mode (see FIG. 8(*f*)).

Figure 8:
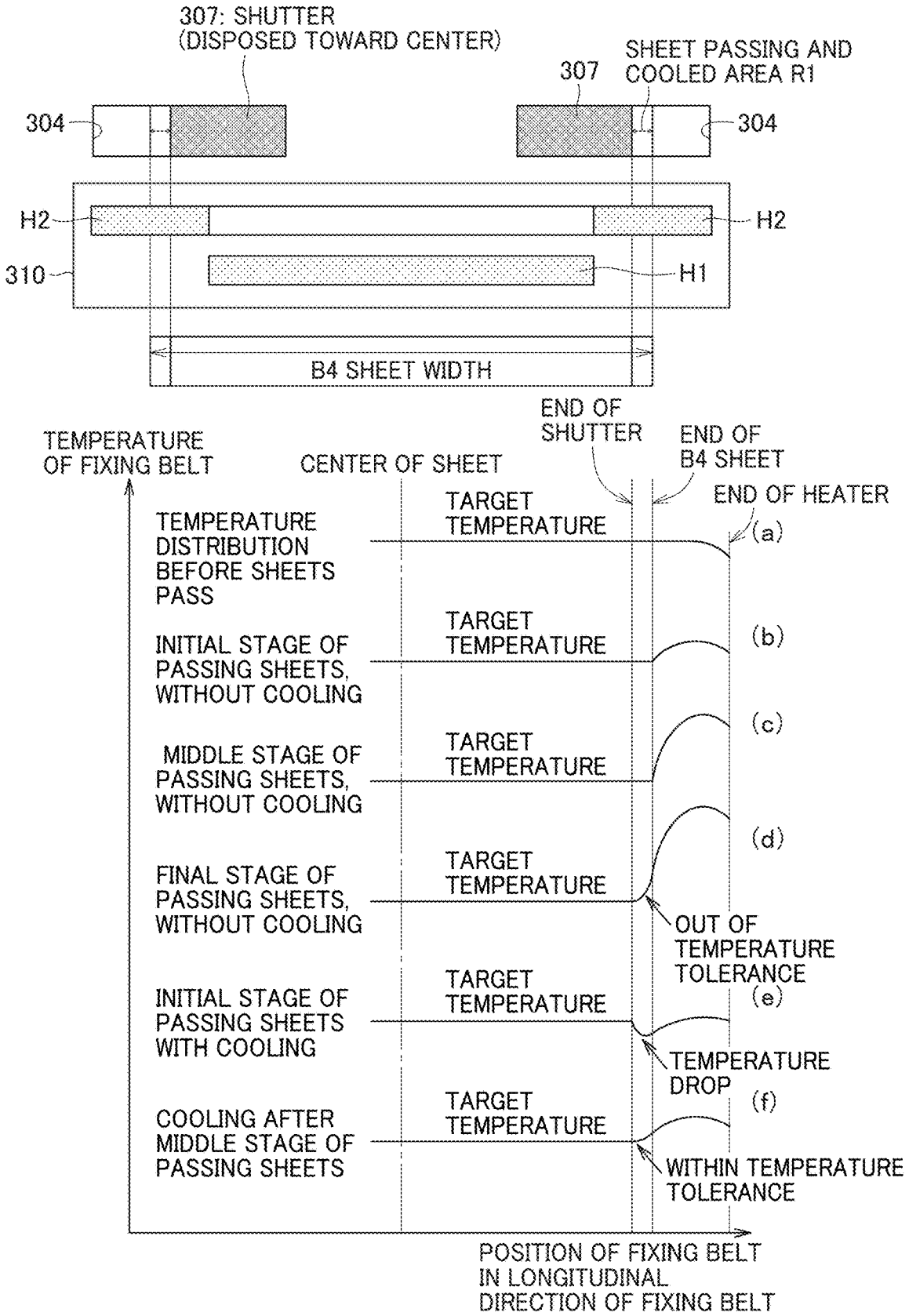
FIG. 8 is an explanatory diagram illustrating temperature distributions of a fixing belt in a longitudinal direction of the fixing belt in the fixing device having the positional relationship between the shutters and the haters as illustrated in FIG. 7B.

Since the temperature rise of the non-sheet passing portion affects the temperature of the end portion of a sheet passing portion that is the sheet passing and cooled area R1 to be high, the high-speed rotation mode of the blower fan 520 cooling the sheet passing and cooled area R1 does not cause the shortage of the fixing heat amount as illustrated in FIG. 8(*f*). As described above, the controller 400 sets the shutter 307 to be disposed toward the center of the fixing belt 310 to cover the opening 304 and switches operation modes of the blower fan 520 (that is, the high-speed rotation mode, the low-speed rotation mode, and the stop mode) when the B4 sheets pass through the fixing device 300. Such combinations of the shielding widths of the shutters 307 and the operation modes of the blower fan 520 can maintain the temperature of the sheet passing and cooled area R1 within the fixing temperature tolerance range even when the shielding width of the shutter 307 in the opening 304 does not cover the sheet passing portion of the B4 sheet.

When the A4 sheet passes through the fixing device 300, the heater H1 is energized, and the heater H2 is not energized. FIG. 7C is a schematic diagram illustrating a positional relationship between the shutters and the heaters heating the A4 sheet.

When the A4 sheet passes through the fixing device 300, the controller 400 as the circuitry stops the blower fan 520 and does not move the shutters 307. In other words, the shutters 307 are at arbitrary slide positions. Since the sheet width coincides with the heating region that the heater H1 heats the fixing belt 310, the local excessive temperature rise at the end portion of the fixing belt 310 does not occur.

Therefore, the controller 400 does not drive the blower fan 520. Since the blower fan 520 is stopped, the cooling air does not flow through the opening 304. The controller 400 does not control the shutter 307. In other words, the shutter 307 may be at the arbitrary position. In the embodiment illustrated in FIG. 7C, the outer ends of shutters 307 are positioned at both ends of the A4 sheet, but the controller 400 may freely determine the slide position of the shutter 307 in accordance with an operation of the fixing device. Note that the controller 400 may perform the same control for a sheet having the letter size as that for the A4 sheet described above.

When the B5 sheet passes through the fixing device 300, the heater H1 is energized, and the heater H2 is not energized. FIG. 7D is a schematic diagram illustrating a positional relationship between the shutters and the heaters heating the B5 sheet.

When the B5 sheet passes through the fixing device 300, the controller 400 sets the blower fan 520 to the high-speed rotation mode and sets the shutters 307 at the inner end portions of the openings 304 in the longitudinal directions of the openings 304 (in other words, to be disposed toward the center of the fixing belt 310) so as to correspond to the width of the B5 sheet.

The width of the heat generation area of the central heater H1 larger than the width of the B5 sheet in the longitudinal direction of the heat generation area of the central heater H1 generates non-sheet passing and cooled areas R2 of the fixing belt 310 on both end portions of the heat generation area of the central heater H1 in the longitudinal direction of the heat generation area of the central heater H1. However, the high-speed rotation mode of the blower fan 520 can prevent the excessive temperature rise in the non-sheet passing and cooled areas R2. In addition, since the shutter 307 can perfectly cover the sheet passing portion of the fixing belt for the B5 sheet, the controller 400 can control the temperature of the sheet passing portion to maintain the target fixing temperature.

When the A5 sheet passes through the fixing device 300, the heater H1 is energized, and the heater H2 is not energized. FIG. 7E is a schematic diagram illustrating a positional relationship between the shutters and the heaters heating the A5 sheet.

When the A5 sheet passes through the fixing device 300, the controller 400 sets the blower fan 520 to the high-speed rotation mode and sets the shutters 307 at the inner end portions of the openings 304 in the longitudinal directions of the openings 304 (in other words, to be disposed toward the center of the fixing belt 310) so as to correspond to the width of the A5 sheet.

The width of the heat generation area of the central heater H1 larger than the width of the A5 sheet in the longitudinal direction of the heat generation area of the central heater H1 generates non-sheet passing and cooled areas R3 of the fixing belt 310 on both end portions of the heat generation area of the central heater H1 in the longitudinal direction of the heat generation area of the central heater H1. However, the high-speed rotation mode of the blower fan 520 can prevent the excessive temperature rise in the non-sheet passing and cooled areas R3. In addition, since the shutter 307 can perfectly cover the sheet passing portion of the fixing belt for the A5 sheet, the controller 400 can control the temperature of the sheet passing portion to maintain the target fixing temperature.

When the B6 sheet passes through the fixing device 300, the heater H1 is energized, and the heater H2 is not energized. FIG. 7F is a schematic diagram illustrating a positional relationship between the shutters and the heaters heating the B6 sheet.

The controller 400 sets the blower fan 520 to the low-speed rotation mode at the start of sheet conveyance, and switches to the high-speed rotation mode in the middle when the number of B6 sheets passing through the fixing device 300 is large. The controller 400 sets the shutter 307 to be at the outer end portion of the opening 304 in the longitudinal direction of the opening 304 (that is, to be disposed toward an end of the fixing belt 310), and the shutters 307 cover both end portions of the fixing belt 310 outside both ends of the central heater H1.

In other words, the inner ends of the shutters 307 in the longitudinal direction of the shutters 307 are positioned at both ends of the central heater H1. In the above, "the inner ends of the shutters 307 are positioned at both ends of the central heater H1" means that the inner ends of the shutters 307 coincide with both ends of the central heater H1 when viewed in the short-side direction of the heater H1, H2, or the fixing belt 310.

Disposing the shutter 307 at the outer end portion of the opening 304 in the longitudinal direction of the opening 304 is a shielding setting specific to the present embodiment. Both ends of the B6 sheet slightly protrude from the inner ends of the opening 304 in the longitudinal direction of the fixing belt 310, and both end portions of the B6 sheet slightly overlap the opening 304 and form sheet passing and cooled areas R4. The size of the sheet passing and cooled area R4, that is, the length in the longitudinal direction of the fixing belt 310 from the inner end of the opening 304 to the end of the B6 sheet depends on the result of optimization of the sizes of the shielding widths of the shutters 307 for the various sheet sizes and the setting of the opening width of the opening 304. In other words, the size of the sheet passing and cooled area R4 is determined so that the control of the blower fan 520 as the cooling fan can maintain temperatures of sheet passing and cooled areas R4 within the fixing temperature tolerance range.

The width of the heat generation area of the central heater H1 larger than the width of the B6 sheet in the longitudinal direction of the heat generation area of the central heater H1 generates non-sheet passing heated areas of the fixing belt 310 on both end portions of the heat generation area of the central heater H1 in the longitudinal direction of the heat generation area of the central heater H1 and outside the sheet passing and cooled areas R4. However, the high-speed rotation mode of the blower fan 520 and shielding the outer end portions of the openings 304 in the longitudinal directions of the openings 304 to the maximum by the shutters 307 can collect the cooling air and send the cooling air to the non-sheet passing heated areas to efficiently prevent the excessive temperature rise in the non-sheet passing heated areas.

When the shutter 307 in the present embodiment is moved based on all sheet sizes, the opening range of the opening 304 set by the shutter 307 does not match the non-sheet passing heated area outside a sheet having at least any one of the sheet sizes. In the present embodiment, it is assumed that the non-sheet passing heated area outside the B6 sheet does not match the opening range. That is, it is assumed that, as a result of overall optimization of the size of the width of the shutter 307 (a shutter width), the non-sheet passing heated area outside the B6 sheet does not match the opening range of the opening 304. In the following description, it is assumed that the inner end of the opening range in the longitudinal direction of the opening 304 is positioned slightly inside the B6 sheet, in other words, positioned to slightly shift from the end of the B6 sheet toward the center of the B6 sheet.

The cooling airflow of the blower fan 520 cools the sheet passing and cooled area R4 of the fixing belt 310 facing an end portion of the B6 sheet because the inner end in the longitudinal direction of the opening range overlaps the end portion of the B6 sheet. In this case, applying the cooling air to the end portion of the fixing belt 310 may cause a shortage of the fixing heat amount (in other words, the temperature drop) because the temperatures of the end portion of the fixing belt 310 and an end portion of the sheet is low immediately after the start of sheet conveyance.

Therefore, immediately after the start of sheet conveyance and before the temperature rise of the non-sheet passing portion, the controller 400 sets the blower fan 520 to the low-speed rotation mode or the stop mode. When the temperature of the non-sheet passing portion rises after a large number of sheets have passed through the fixing device 300, the controller 400 switches the blower fan 520 to the high-speed rotation mode.

Since the temperature rise of the non-sheet passing portion affects the temperature of the end portion of the sheet passing portion that is the sheet passing and cooled area R4 to be high, the high-speed rotation mode of the blower fan 520 cooling the sheet passing and cooled area R4 does not cause the shortage of the fixing heat amount. As described above, the controller 400 sets the shielding width of the shutter 307 and switches operation modes of the blower fan 520 when the B6 sheets pass through the fixing device 300. Such combinations of the shielding widths of the shutters 307 and the operation modes of the blower fan 520 can maintain the temperature of the sheet passing and cooled area R4 within the fixing temperature tolerance range even when the non-sheet passing heated area outside the B6 sheet does not match the opening range of the opening 304.

On the other hand, the controller 400 sets the shutter 307 to be at the outer end portion of the opening 304 in the longitudinal direction of the opening 304. In other words, the inner ends of the shutters 307 in the longitudinal direction of the shutters 307 are positioned at both ends of the central heater H1. In the above, "the inner ends of the shutters 307 are positioned at both ends of the central heater H1" means that the inner ends of the shutters 307 in the longitudinal direction of the shutters 307 coincide with both ends of the central heater H1 when viewed in the short-side direction of the heater H1, H2, or the fixing belt 310.

Since the end heaters H2 are not energized and do not generate heat when the B6 sheet passes through the fixing device 300, non-sheet passing portions of both end portions of the fixing belt 310 corresponding to the end heaters H2 are not needed to be cooled. Therefore, the shutters 307 shield parts of the openings 304 facing the non-sheet passing portions. Shielding the parts of the openings 304 facing the non-sheet passing portions that are not needed to be cooled collects the cooling air and sends the cooling air to other non-sheet passing portions in which both end portions of the central heater H1 cause local temperature rise. As a result, the cooling efficiency is improved.

Figure 7G:
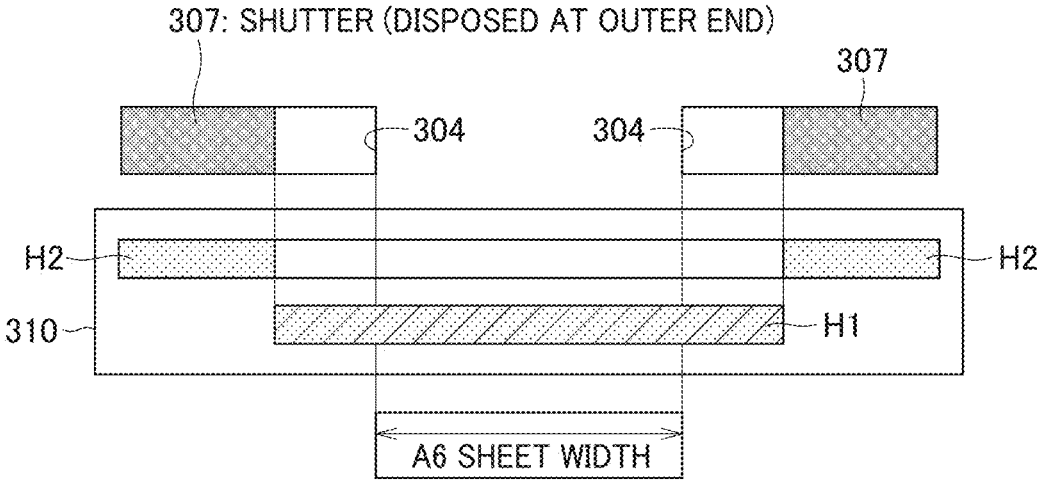
FIG. 7G is a schematic diagram illustrating a positional relationship between the shutters and the haters heating a A6 sheet.

When the A6 sheet passes through the fixing device 300, the heater H1 is energized, and the heater H2 is not energized. FIG. 7G is a schematic diagram illustrating a positional relationship between the shutters and the heaters heating the A6 sheet.

When the A6 sheet passes through the fixing device 300, the controller 400 sets the blower fan 520 to the high-speed rotation mode and sets the shutter 307 to be at the outer end portion of the opening 304 in the longitudinal direction of the opening 304 (that is, to be disposed toward the end of the fixing belt 310), and the shutters 307 cover both end portions of the fixing belt 310 outside both ends of the central heater H1. Disposing the shutter 307 at the outer end portion of the opening 304 in the longitudinal direction of the opening 304 is the shielding setting specific to the present embodiment.

The setting of the opening range in each of the openings 304 for the A6 sheet is the same as that for the B6 sheet illustrated in FIG. 7F. Accordingly, the shutter 307 is not disposed toward the center of the fixing belt 310. The above-described configuration can appropriately cool non-sheet passing portions of the fixing belt 310 outside the both ends of the A6 sheet in the longitudinal direction of the fixing belt 310, the non-sheet passing portions in which the local temperature rise occurs.

On the other hand, the controller 400 sets the shutter 307 to be at the outer end portion of the opening 304 in the longitudinal direction of the opening 304. In the present embodiment, the inner ends of the shutters 307 coincide with both ends of the central heater H1, which is similar to the shutters 307 illustrated in FIG. 7F. In addition, since the end heaters H2 are not energized when the A6 sheet passes through the fixing device 300, portions of the fixing belt 310 that are not heated by the end heaters H2 are not needed to be cooled.

Since the openings 304 in the fixing device according to the comparative embodiment are fully opened to cool the non-sheet passing portions of the fixing belt, the cooling efficiency is bad in many cases. Since setting the shutters 307 as illustrated in FIG. 7G can cool the non-sheet passing portions in which both end portions of the central heater H1 cause local temperature rise, the cooling efficiency is improved.

The following describes temperature distributions of the fixing belt 310 when the B4 sheets pass through the fixing device 300.

FIG. 8 schematically illustrates the temperature distributions from the center of the fixing belt to the right end of the fixing belt in the longitudinal direction of the fixing belt when the B4 sheets pass through the fixing device as described above with reference to FIG. 7B. FIG. 8(*a*) illustrates a temperature distribution before the B4 sheets pass through the fixing device 300. FIG. 8(*b*) to (*d*) illustrate temperature distributions when the fixing belt is not cooled, and when the B4 sheets pass through the fixing device. FIGS. 8(*e*) and (*f*) illustrate temperature distributions when the fixing belt is cooled, and when the B4 sheets pass through the fixing device.

The vertical axis in each of (a) to (f) separately and independently indicates the temperature of surface of the fixing belt. Horizontal straight lines extending from the center of the fixing belt corresponding to the center of the sheet indicates that the temperature of the fixing belt is controlled to the target temperature (for example, 170° C.). The temperature distribution indicates whether the blower fan 520 is appropriately controlled.

FIG. 8(*a*) illustrates the temperature distribution before the sheets start to pass through the fixing device, that is, under a standby state. The temperature of the entire fixing belt is uniformly maintained at the target temperature (for example, 170° C.). FIGS. 8(*b*) to 8(*d*) illustrate the temperature distributions of the fixing belt arranged in chronological order when the B4 sheets continuously pass through the fixing device, and the blower fan is stopped.

FIG. 8(*b*) illustrates the temperature distribution of the fixing belt in an initial stage when the B4 sheets pass through the fixing device, and the blower fan is stopped. The center heater H1 and the end heaters H2 are energized to generate heat and heat the fixing belt and the B4 sheets. The temperature starts to rise in the outer end portion of the fixing belt that is on the heat generation area of the end heater H2 and does not contact the B4 sheets, that is, the non-sheet passing portion. In the initial stage when the B4 sheets pass through the fixing device, the temperature rise amount is small. The temperature of the fixing belt does not cause a problem of the fixing belt and other peripheral members (that is, cooling is unnecessary).

FIG. 8(*c*) illustrates the temperature distribution of the fixing belt in a middle stage when the B4 sheets pass through the fixing device 300, and the blower fan is stopped. The temperature of the non-sheet passing portion of the fixing belt further increases from the temperature illustrated in FIG. 8(*b*) (for example, higher than the high temperature threshold of 180° C. and lower than 200° C.). The large temperature rise may cause the problem of the fixing belt and other peripheral members. Cooling the non-sheet passing portion is preferable.

FIG. 8(*d*) illustrates the temperature distribution of the fixing belt in a final stage when the B4 sheets pass through the fixing device 300, and the blower fan is stopped. The temperature of the non-sheet passing portion of the fixing belt further increases from the temperature illustrated in FIG. 8(*c*). The temperature rise affects the temperature of the end portion of the B4 sheet to be out of the fixing temperature tolerance range, which may cause an abnormal image in the end portion. The temperature out of the fixing temperature tolerance is, for example, higher than 200° C. and lower than 220° C., which causes a problem such as a reduction in heat resistance life of the fixing belt and other peripheral members. Cooling the non-sheet passing portion is preferable.

FIGS. 8(*e*) and 8(*f*) illustrate temperature distributions of the fixing belt when the blower fan is operated, and B4 sheets pass through the fixing device. The difference between FIGS. 8(*e*) and (*f*) is a switching timing of the operation modes of the blower fan.

FIG. 8(*e*) illustrates the temperature distribution of the fixing belt in the initial stage when the B4 sheets pass through the fixing device 300, and when the controller 400 sets the blower fan to the high-speed rotation mode immediately after the B4 sheets start to pass through the fixing device 300 to prevent the temperature rise in the non-sheet passing portion. The controller 400 performs the same control as the control when the B5, A5, or A6 sheets pass through the fixing device and are heated. The controller 400 controls the blower fan to rotate in the high-speed rotation mode in the initial stage when the B4 sheets pass through the fixing device. The portion indicated by the arrow in FIG. 8(*f*) is the sheet passing and cooled area R1 in which the temperature drop is caused by cooling of the blower fan.

Since the temperature of the fixing belt is close to the target temperature inside the sheet passing and cooled area R1, operating the blower fan in the high-speed rotation mode in the initial stage when the B4 sheets pass through the fixing device similar to the operations when the B5, A5, or A6 sheets pass through the fixing device increases a heat mount removed from the sheet passing and cooled area R1, causes the temperature drop, and causes an abnormal image. For this reason, the above-described control is not possible when the B4 sheets pass through the fixing device.

FIG. 8(*f*) illustrates the temperature distribution of the fixing belt when the controller 400 controls the blower fan to switch from the stop mode or the low-speed rotation mode to the high-speed rotation mode after the middle stage when the B4 sheets pass through the fixing device 300 to avoid the temperature drop as illustrated in FIG. 8(*e*) because the temperature rise of the non-sheet passing portion affects the temperature of the sheet passing and cooled area R1 to be high after the middle stage.

Since the temperature rise of the non-sheet passing portion of the fixing belt is small from the initial stage to the middle stage when the B4 sheets pass through the fixing device as described above with reference to FIGS. 8(*b*) and (*c*), the controller 400 does not set the blower fan to the high-speed rotation mode. As illustrated in FIG. 8(*d*), the temperature rise of the non-sheet passing portion affects the temperature of the sheet passing and cooled area R1 to be high in the final stage when the B4 sheets pass through the fixing device.

As illustrated in FIG. 8(*f*), setting the blower fan to the high-speed rotation mode after the middle stage, not from the initial stage when the B4 sheets pass through the fixing device avoids the occurrence of the temperature drop as indicated by the arrow in FIG. 8(*e*). In FIG. 8(*f*), the temperature of the sheet passing and cooled area R1 is within the fixing temperature tolerance range, and the temperature rise of the non-sheet passing portion can also be reduced.

When the B6 sheets pass through the fixing device, the controller 400 may control the blower fan to switch the operation modes of the blower fan in the same manner as the manner described above when the B4 sheets pass through the fixing device. As described above, the fixing device according to the present embodiment can effectively prevent the local temperature rise of the fixing belt with a simple configuration.

As described above, the temperature of the non-sheet passing portion of the fixing belt 310 on the end of the end heater H2 is low before the sheets start to pass through the fixing device as illustrated in FIG. 8(*a*), but the temperature of the non-sheet passing portion increases as illustrated in FIGS. 8(*b*) to (*d*) while the sheets pass through the fixing device. In the final stage when the sheets pass through the fixing device, the temperature of the non-sheet passing portion is out of the fixing temperature tolerance range as illustrated in FIG. 8(*d*), which may cause a fixing failure.

To avoid the fixing failure, the controller 400 starts driving the blower fan 520 in the middle stage when the sheets pass through the fixing device to cool the non-sheet passing portion including the sheet passing and cooled area R1 by the cooling air. As a result, the temperature of the sheet passing and cooled area R1 is maintained within the fixing temperature tolerance range, which prevents the fixing failure. Starting driving the blower fan 520 from the initial stage when the sheets pass through the fixing device causes the temperature drop in the sheet passing and cooled area R1 as illustrated in FIG. 8(*e*), which may cause the fixing failure.

FIG. 9 is a table summarizing the above description. As illustrated in FIG. 9, controlling the positions of the shutters 307 and the operation modes of the blower fan 520 based on the sheet sizes can improve the cooling effect.

Although some embodiments of the present disclosure have been described above, embodiments of the present disclosure are not limited to the embodiments described above, and a variety of modifications can be made within the scope of the present disclosure. For example, the central heater H1 and the end heaters H2 are not necessarily planar heaters, but may be replaced with other types of heaters such as halogen heaters.

Figure 10:
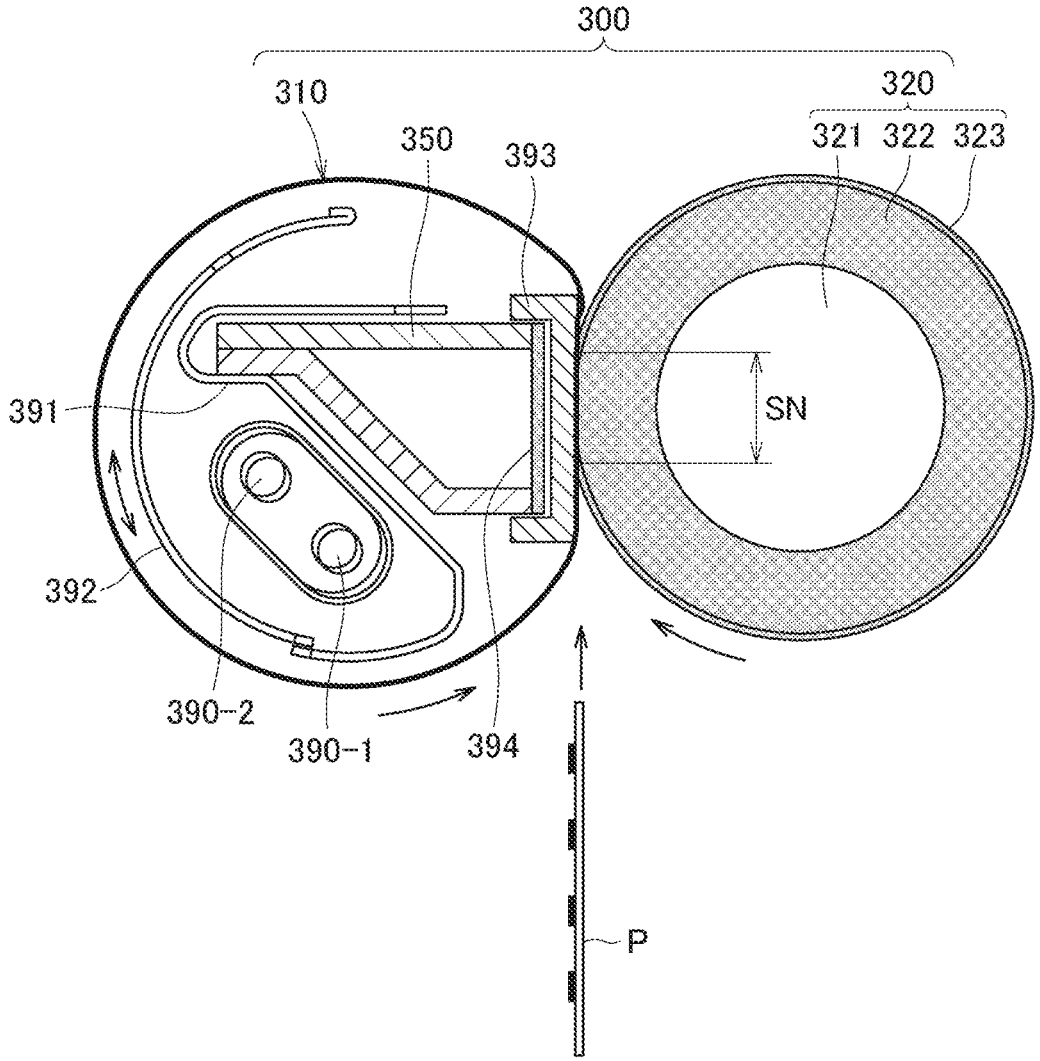
FIG. 10 is a cross-sectional view of a fixing device including two halogen heaters.

FIG. 10 is a schematic cross-sectional view of a fixing device 300 including two halogen heaters 390-1 and 390-2 instead of the central heater H1 and the end heaters H2. The heat of the two halogen heaters 390-1 and 390-2 heats the inner surface of the fixing belt 310. One halogen heater 390-1 corresponds to the central heater H1, and the other halogen heaters 390-2 corresponds to the end heaters H2.

A reflector 391 is disposed behind the halogen heaters 390-1 and 390-2, and a shield 392 rotatable in the direction indicated by arrow is disposed in front of the halogen heaters 390-1 and 390-2. In order to prevent the non-sheet passing portions at both ends of the fixing belt 310 from being overheated, the shield 392 covers the outer end portion of the halogen heater 390-2 in the longitudinal direction of the halogen heater 390-2 based on the sheet size.

A nip formation pad 393 is disposed so as to face the pressure roller 320 to form the fixing nip SN therebetween. A thermal equalizer 394 made of a high thermal conduction material is disposed on the back side of the nip formation pad 393 to equalize the temperature distribution in the longitudinal direction of the fixing belt 310.

The heating rotator may be in any form such as a roller, a belt, or a sleeve, in addition to the form of the fixing belt. In the above embodiment, the blower fan 520 is disposed outside the shutter 307. However, the blower fans 520 may be replaced by suction fans each disposed in an exhaust duct disposed on an upper side of the housing 301 and each connected to the opening 304. When the suction fans suck and exhaust the air in the housing 301, air sucked from the openings 304 in the horizontal lateral direction cools the non-sheet passing portions at both end portions of the fixing belt 310. The shutter 307 adjusts an intake amount of air or an intake range of air.

Although the shutters 307 are disposed outside the openings 304 so as to be openable and closable, the shutters 307 may be disposed inside the openings 304 so as to be openable and closable. Although the heating rotator in the above-described embodiment is the fixing belt 310, the heating rotator may be a fixing roller having a heater inside instead of the fixing belt 310.

The heating device of the present disclosure may be used not only for the fixing device 300 described above, but also for a sheet drying device for an inkjet printer. In addition to the PTC element used in the heater 330, other heat generator such as a ceramic heater may be used as the heat generator to heat the fixing belt 310.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure. Each of the functions of the described embodiments may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

What is claimed is:

1. A heating device comprising:

a heating rotator;

a pressing rotator being configured to press against the heating rotator to form a nip passing through a recording medium with the heating rotator;

a heater disposed inside the heating rotator, the heater including a central heater configured to heat a center portion of the heating rotator in a longitudinal direction of the heating rotator, and end heaters disposed outside both ends of the central heater in a longitudinal direction of the central heater and configured to heat both end portions of the heating rotator in the longitudinal direction of the heating rotator;

a fan;

a housing that houses the heating rotator and the pressing rotator, the housing having a pair of openings each configured to allow airflow generated by the fan to pass through each of the pair of openings;

a pair of shutters each configured to slide in corresponding one of the pair of openings in a longitudinal direction of the corresponding one of the pair of openings, each of the pair of shutters configured to slide between a position at which an outer end portion of the corresponding one of the pair of openings is opened in the longitudinal direction of the corresponding one of the pair of openings and a position at which an inner end portion of the corresponding one of the pair of openings is opened in the longitudinal direction of the corresponding one of the pair of openings; and circuitry configured to determine activation statuses of the central heater and the end heaters, an operation mode of the fan, and a position of the pair of shutters at a time the recording medium passes through the nip based on a width of the recording medium in the longitudinal direction of the heating rotator, to control the pair of shutters to open the pair of openings to overlap the width of the recording medium in the longitudinal direction while the recoding medium passes the nip, and to control the fan to allow airflow onto both the recording medium and heater.

2. The heating device according to claim 1, wherein each of the pair of shutters has a shielding width shorter than an opening width of the corresponding one of the pair of openings in the longitudinal direction of the corresponding one of the pair of openings.

3. The heating device according to claim 1, wherein the circuitry is configured to, based on a width of the recording medium larger than a width of a heat generation area of the central heater in the longitudinal direction of the central heater, energize the central heater and the end heaters, drive the fan, and slide the pair of shutters to positions at which positions of outer ends of the pair of shutters in longitudinal directions of the pair of shutters are inside and near both ends of the recording medium in the width direction.

4. The heating device according to claim 1, wherein the circuitry is configured to, based on a width of the recording medium equal to or smaller than a width of a heat generation area of the central heater in the longitudinal direction of the central heater, energize the central heater, drive the fan, and slide the pair of shutters to positions at which positions of outer ends of the pair of shutters in longitudinal directions of the pair of shutters are inside and near both ends of the recording medium in the width direction and not to energize the end heaters.

5. The heating device according to claim 1, wherein the circuitry is configured to, based on a width of the recording medium smaller than a width of a heat generation area of the central heater in the longitudinal direction of the central heater, energize the central heater, drive the fan, and slide the pair of shutters to positions at which positions of inner ends of the pair of shutters in longitudinal directions of the pair of shutters are at both ends of the central heater in the longitudinal direction of the central heater and not to energize the end heaters.

6. The heating device according to claim 1, wherein the heater includes at least one of a planar heater or a halogen heater.

7. A fixing device comprising the heating device according to claim 1.

8. An image forming apparatus comprising the fixing device according to claim 7.

9. The heating device according to claim 1, wherein circuitry is configured to control the pair of shutters to cover a non-recording medium passing area and the end heaters based on the end heaters not being activated.

10. A heating device comprising:

a heating rotator;

a pressing rotator being configured to press against the heating rotator to form a nip passing through a recording medium with the heating rotator;

a heater disposed inside the heating rotator, the heater including:

a central heater configured to heat a center portion of the heating rotator in a longitudinal direction of the heating rotator, and end heaters disposed outside both ends of the central heater in a longitudinal direction of the central heater and configured to heat both end portions of the heating rotator in the longitudinal direction of the heating rotator;

a fan;

a housing that houses the heating rotator and the pressing rotator, the housing having a pair of openings each configured to allow airflow generated by the fan to pass through each of the pair of openings;

a pair of shutters each configured to slide in corresponding one of the pair of openings in a longitudinal direction of the corresponding one of the pair of openings, each of the pair of shutters configured to slide between a position at which an outer end portion of the corresponding one of the pair of openings is opened in the longitudinal direction of the corresponding one of the pair of openings and a position at which an inner end portion of the corresponding one of the pair of openings is opened in the longitudinal direction of the corresponding one of the pair of openings; and circuitry configured to determine an operation mode of the fan, and a position of the pair of shutters at a time the recording medium passes through the nip based on an activation status of each of the central heater and the end heaters.

11. The heating device according to claim 10, wherein each of the pair of shutters has a shielding width shorter than an opening width of the corresponding one of the pair of openings in the longitudinal direction of the corresponding one of the pair of openings.

12. The heating device according to claim 10, wherein the circuitry is configured to, based on a width of the recording medium larger than a width of a heat generation area of the central heater in the longitudinal direction of the central heater, energize the central heater and the end heaters, drive the fan, and slide the pair of shutters to positions at which positions of outer ends of the pair of shutters in longitudinal directions of the pair of shutters are at both ends of the recording medium in a width direction of the recording medium or inside and near both ends of the recording medium in the width direction.

13. The heating device according to claim 10, wherein the circuitry is configured to, based on a width of the recording medium equal to or smaller than a width of a heat generation area of the central heater in the longitudinal direction of the central heater, energize the central heater, drive the fan, and slide the pair of shutters to positions at which positions of outer ends of the pair of shutters in longitudinal directions of the pair of shutters are at both ends of the recording medium in a width direction of the recording medium or inside and near both ends of the recording medium in the width direction and not to energize the end heaters.

14. The heating device according to claim 10, wherein the circuitry is configured to, based on a width of the recording medium smaller than a width of a heat generation area of the central heater in the longitudinal direction of the central heater, energize the central heater, drive the fan, and slide the pair of shutters to positions at which positions of inner ends of the pair of shutters in longitudinal directions of the pair of shutters are at both ends of the central heater in the longitudinal direction of the central heater and not to energize the end heaters.

* * * * *